US011319737B2

(12) United States Patent
Nordieker et al.

(10) Patent No.: US 11,319,737 B2
(45) Date of Patent: May 3, 2022

(54) FLAP FITTING FOR A PIECE OF FURNITURE, SIDE WALL OF A BODY OF A PIECE OF FURNITURE AND PIECE OF FURNITURE COMPRISING A SIDE WALL

(71) Applicant: HETTICH-ONI GMBH & CO. KG, Vlotho (DE)

(72) Inventors: Martin Nordieker, Hüllhorst (DE); Jens Poischbeg, Leopoldshöhe (DE); Michael Tasche, Bielefeld (DE); Karsten Nolte, Lemgo (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 37 days.

(21) Appl. No.: 16/762,809

(22) PCT Filed: Nov. 6, 2018

(86) PCT No.: PCT/EP2018/080313
§ 371 (c)(1),
(2) Date: May 8, 2020

(87) PCT Pub. No.: WO2019/091967
PCT Pub. Date: May 16, 2019

(65) Prior Publication Data

US 2021/0189780 A1 Jun. 24, 2021

(30) Foreign Application Priority Data

Nov. 10, 2017 (DE) ..... 10 2017 126 367.5

(51) Int. Cl.
*E05D 7/00* (2006.01)
*E05D 3/06* (2006.01)
*E05F 11/54* (2006.01)

(52) U.S. Cl.
CPC ..... *E05D 3/06* (2013.01); *E05F 11/54* (2013.01); *E05Y 2900/20* (2013.01)

(58) Field of Classification Search
CPC ..... E05F 1/1276; E05F 1/1246; E05F 1/1253; E05F 1/1261; E05F 1/1058; E05F 1/1075;
(Continued)

(56) References Cited

U.S. PATENT DOCUMENTS 5,937,479 A * 8/1999 Ohshima ..... E05D 7/125 16/257
6,553,621 B2 * 4/2003 Isele ..... E05D 7/0407 16/238
(Continued)

FOREIGN PATENT DOCUMENTS

CN 104912421 A 9/2015
DE 10063266 A1 7/2002
(Continued)

OTHER PUBLICATIONS

International Search Report dated Jan. 23, 2019 in related/corresponding International Application No. PCT/EP2018/080313.
(Continued)

*Primary Examiner* — Chuck Y Mah
(74) *Attorney, Agent, or Firm* — Patent Portfolio Builders PLLC

(57) ABSTRACT

A flap fitting for a piece of furniture includes a compound lever with a door bearing lever, a slope-increasing device, and a mounting plate to which a wing of the piece of furniture is secured. A lateral position and an incline of the mounting plate is adjustable relative to the door bearing lever by the slope-increasing device. The flap fitting includes a housing having two side plates arranged in parallel and at a distance from each other. The compound lever with the door bearing lever and the slope-increasing device being
(Continued)

positioned between the side plates in a closing position of the flap fitting.

24 Claims, 21 Drawing Sheets

(58) Field of Classification Search
CPC .... E05F 5/02; E05F 3/20; E05F 11/54; E05D 3/16; E05D 11/00; E05D 15/40; E05D 2003/163; E05D 3/06; E05Y 2201/10; E05Y 2201/256; E05Y 2201/21; E05Y 2201/264; E05Y 2201/47; E05Y 2201/492; E05Y 2900/20; E05Y 2900/202; E05Y 2600/10; E05Y 2600/41; A47B 2220/0072; Y10T 16/5383; Y10T 16/547; Y10T 16/5476; Y10T 16/5321; Y10T 16/5322; Y10T 16/53225
See application file for complete search history.

(56) References Cited

U.S. PATENT DOCUMENTS

| | | | | |
|---|---|---|---|---|
| 8,321,996 | B2 * | 12/2012 | Hirtsiefer | E05D 15/46 16/286 |
| 8,807,670 | B2 * | 8/2014 | Blum | A47B 96/00 312/319.2 |
| 8,959,709 | B2 * | 2/2015 | Hasegawa | E05F 1/1261 16/65 |
| 9,464,473 | B2 * | 10/2016 | Baldreich | E05F 1/1058 |
| 10,370,884 | B2 * | 8/2019 | Stuke | E05F 1/1008 |
| 10,588,407 | B2 | 3/2020 | Held | |
| 10,881,207 | B2 | 1/2021 | Sobolewski et al. | |
| 10,968,672 | B2 * | 4/2021 | Schmid | E05F 1/14 |
| 2007/0257538 | A1 * | 11/2007 | Brunnmayr | E05D 15/262 297/423.12 |
| 2008/0134464 | A1 * | 6/2008 | Salice | E05F 1/1058 16/84 |
| 2013/0239363 | A1 * | 9/2013 | Apur | E05F 5/006 16/50 |
| 2017/0044812 | A1 * | 2/2017 | Schluge | E05F 5/02 |
| 2018/0363348 | A1 * | 12/2018 | Schluge | E05F 1/14 |

FOREIGN PATENT DOCUMENTS

| | | | |
|---|---|---|---|
| DE | 102006044873 | A1 | 4/2008 |
| DE | 102015108694 | A1 | 12/2015 |
| EP | 1990491 | A1 | 11/2008 |
| EP | 2021567 | B1 | 5/2012 |
| EP | 1990493 | B1 | 10/2015 |
| WO | 2017029199 | A1 | 2/2017 |
| WO | 2018158153 | A1 | 9/2018 |

OTHER PUBLICATIONS

Search Report created on Nov. 19, 2018 in related/corresponding DE Application No. 10 2017 126 367.5.
Written Opinion dated Jan. 23, 2019 in related/corresponding International Application No. PCT/EP2018/080313.
Office Action dated Apr. 12, 2021 in related/corresponding EP Application No. 18 799 523.8.

* cited by examiner

FLAP FITTING FOR A PIECE OF FURNITURE, SIDE WALL OF A BODY OF A PIECE OF FURNITURE AND PIECE OF FURNITURE COMPRISING A SIDE WALL

BACKGROUND AND SUMMARY OF THE INVENTION

Exemplary embodiments of the invention relate to a flap fitting for an item of furniture, comprising a lever mechanism having a door bearing lever, an adjustment unit, and an installation plate, on which a flap of the item of furniture is fastenable. In this case, the adjustment unit permits a lateral adjustment and an inclination adjustment of the installation plate in relation to the door bearing lever. Exemplary embodiments of the invention furthermore relate to a side wall of a furniture body and an item of furniture having a side wall.

Items of furniture, in particular kitchen furniture such as base cabinets or hanging cabinets, generally have a furniture body open toward the front, on which movable furniture parts guided via fittings are installed. In particular in the case of hanging cabinets, flaps, which are mounted via at least one or generally two laterally arranged flap fittings, are frequently used as movable furniture parts for closing the furniture body. The flap fittings enable opening upward (pivoting up) of the flap around an imaginary pivot axis arranged horizontally extending in the upper region of the furniture body.

The lever mechanism of the flap fitting is typically formed in multiple parts as a multi-joint lever mechanism, so that the so-called door bearing lever, on which the flap is fastened—possibly indirectly via an installation plate—executes a combined pivoting and sliding movement or a pivoting movement, which takes place around a pivot point located outside the flap fitting and generally also outside the furniture body.

A flap fitting of the type mentioned at the outset is known from document EP 1 990 493 B1. In this flap fitting, an adjustment unit is arranged between the door bearing lever and an installation plate connected to the flap, which unit permits an adjustment of the installation plate in relation to the door bearing lever to compensate for installation and production tolerances of the furniture body and/or the flap fitting or the flap in such a way that the flap presses circumferentially against the furniture body in the closed state and the flap has a uniform gap dimension in relation to the flaps, doors, or drawer elements of adjacent pieces of furniture.

For this purpose, the adjustment unit comprises two adjustment plates, located between the installation plate and the door bearing lever and are arranged one over the other. An inclination adjustment is achieved in that one of the adjustment plates is tiltable in relation to the door bearing lever. A lateral adjustment is enabled in that the two adjustment plates are mounted displaceably in relation to one another. In this case, the lateral adjustment can take place in two directions, which are preferably perpendicular to one another. With respect to a vertically installed plate (in the closed position), the lateral adjustment is then used for sideways and/or vertical correction.

In particular, the lateral displaceability of the two adjustment plates in relation to one another is accompanied by a large lateral space requirement for the two adjustment plates. According to the document EP 1 990 491 B1, the flap fitting is fastened on an inner side of the furniture body and thus protrudes into the interior of the furniture body. Accordingly, sufficient space is available both for the flap fitting itself and also for its adjustment unit. The adjustment unit is not subject to any size restrictions—except for visual aspects.

Exemplary embodiments of the present invention are directed to a flap fitting, in which an adjustment unit for a lateral and inclination adjustment of the furniture flap can also be produced in the case of a flap fitting integrated or inserted into a side wall of the item of furniture. It is a further object to provide a side wall for a furniture body and/or an item of furniture having such a flap fitting and its advantages.

A flap fitting according to the invention of the type mentioned at the outset is distinguished in that the flap fitting comprises a housing having two side plates arranged in parallel and spaced apart in relation to one another, wherein the lever mechanism having the door bearing lever and the adjustment unit are retracted between the side plates in a closed position of the flap fitting.

According to the invention, the adjustment unit is thus designed and arranged on the lever mechanism in such a way that it can retract between the side plates of the housing of the flap fitting. The flap fitting can thus be incorporated into a side wall of the furniture body or can be inserted into the side wall in a pocket incorporated from the end face of the side wall, without an additional free cut having to be provided in the region of the front edge of the side wall of the furniture body, which accommodates the adjustment unit in the closed state of the flap. A flap fitting that is simple to install and simultaneously does not negatively affect the appearance of the furniture body in the open state is thus provided, in which a convenient setting capability of the lateral position (vertical and/or sideways position of the flap) and of the angle of inclination do not have to be omitted.

In one advantageous design of the flap fitting, the adjustment unit comprises a U-shaped outer profile, in which an adapter is mounted so it is longitudinally displaceable and pivotable. The U-shaped outer profile is preferably integrally formed with the door bearing lever and is provided with an oblong hole, through which a bolt leads, which is fastened in legs of the U-shaped outer profile.

Furthermore, a longitudinal adjustment eccentric for the longitudinal displacement of the adapter in relation to the outer profile is preferably arranged in the outer profile. In this case, the longitudinal adjustment eccentric is, for example, rotatably mounted in the outer profile and engages with a driver pin positioned eccentrically on the head in a transversely extending coupling slot of the adapter.

In a further advantageous design of the flap fitting, an inclination adjustment screw for the inclination adjustment of the adapter in relation to the outer profile is arranged in the outer profile. In this case, the inclination adjustment screw is preferably screwed with an external thread into an internal thread of a receptacle on the outer profile, wherein a groove is formed on a shaft of the inclination adjustment screw, which engages in a receptacle of the adapter in such a way that the inclination adjustment screw is coupled to the adapter so it is rotatable and longitudinally displaceable. Furthermore, the inclination adjustment screw is preferably rotatably mounted in the outer profile and engages with an outer thread directly or via a threaded sleeve having a groove in a receptacle of the adapter in such a way that the inclination adjustment screw is coupled to the adapter so it is longitudinally displaceable.

In a further advantageous design of the flap fitting, the adjustment unit comprises a U-shaped installation profile, which is mounted so it is displaceable in a transverse direction on the installation plate. The installation profile preferably rests with a base on the installation plate, the adapter being at least partially positioned between legs of the installation profile.

Furthermore, the legs of the installation profile preferably comprise recesses, wherein sections of the adapter are positioned in the recesses. The sections of the adapter positioned in the recesses can be flush with the outer side of the legs of the installation profile in this case. In this manner, the adapter can be wider by the side wall thickness of the installation profile in the regions of the recesses than in other regions, without the adapter protruding laterally beyond the outer dimensions of the installation profile. The adapter is thus not completely enclosed by the installation profile, but rather only in specific regions that can be formed narrower because of the design than other regions. In this way, the smallest possible overall width of the installation profile and the adapter is achieved, which contributes to the adjustment unit also being able to retract between the side plates of a housing of the flap fitting even in the case of a narrow flap fitting, which can be inserted or integrated into a side wall of a furniture body.

In a further advantageous design of the flap fitting, a lateral adjustment eccentric for the lateral adjustment of the installation profile in relation to the installation plate is arranged in the installation profile. The lateral adjustment eccentric is preferably arranged having a round head precisely between the legs of the installation profile and engages in a coupling borehole of the driver plate with a driver pin positioned eccentrically on the head. A lateral adjustment unit which can be constructed very compactly is thus implemented for the installation plate and therefore an installed flap.

In a further advantageous design of the flap fitting, the installation profile comprises slots open toward one side in its legs, using which it is applied to the bolt. In this case, the adapter preferably comprises a displaceable catch slide on its end opposite to the bolt, which interacts with the installation profile, for example, by a catch lug being formed on the installation profile, behind which the catch slide engages. The flap having installation plate fastened thereon can thus be removed from the flap fitting easily and/or installed again.

In a further advantageous design of the flap fitting, the adjustment unit comprises operable adjustment means, which can be actuated from one side of the adjustment unit. Here, the adjustment means are, for example, the above-mentioned inclination adjustment screw, the longitudinal adjustment eccentric, and/or the lateral adjustment eccentric. The adjustment means are preferably not accessible in the closed position of the flap fitting and are thus inoperable.

In a further advantageous design of the flap fitting, joint axes of the lever mechanism, which are mounted on the door bearing lever, are covered by the side plates in the closed state of the flap fitting. The door bearing lever preferably comprises a support section in this case, at which the adjustment means are accessible, and the support section is concealed by the side plates in the closed state of the flap fitting.

In a further advantageous design of the flap fitting, the side plates have an inner spacing which is greater than the width of the adjustment unit and is less than 16 mm (millimeter) or preferably less than 14 mm. Such a flap fitting is suitable for use and/or integration into a furniture construction plate of a thickness which is used for side walls of furniture bodies.

A side wall according to the invention for a furniture body is distinguished in that such a flap fitting is inserted or integrated. An item of furniture according to the invention having a furniture body and a guided flap is distinguished by such a furniture body having at least one side wall having inserted or integrated flap fitting. The advantages mentioned in conjunction with the flap fitting result. In particular, an item of furniture having a guided flap can be provided, the interior of which can be used in its entire size, which can be designed freely, and which is visually appealing.

BRIEF DESCRIPTION OF THE DRAWING FIGURES

The invention will be explained in greater detail hereafter on the basis of exemplary embodiments with the aid of figures. In the figures:

FIS. 1*a*, 1*b* show an isometric view and a side view of an exemplary embodiment of a flap fitting in a closed position having open housing;

FIGS. 2*a*, 2*b* shows the flap fitting of FIGS. 1*a* and 1*b* in an isometric view or a side view, respectively, in an open position;

FIGS. 3*a*, 3*b* show the flap fitting of the preceding figures having closed housing in a closed (FIG. 3*a*) and a partially open (FIG. 3*b*) position;

Figure 5:
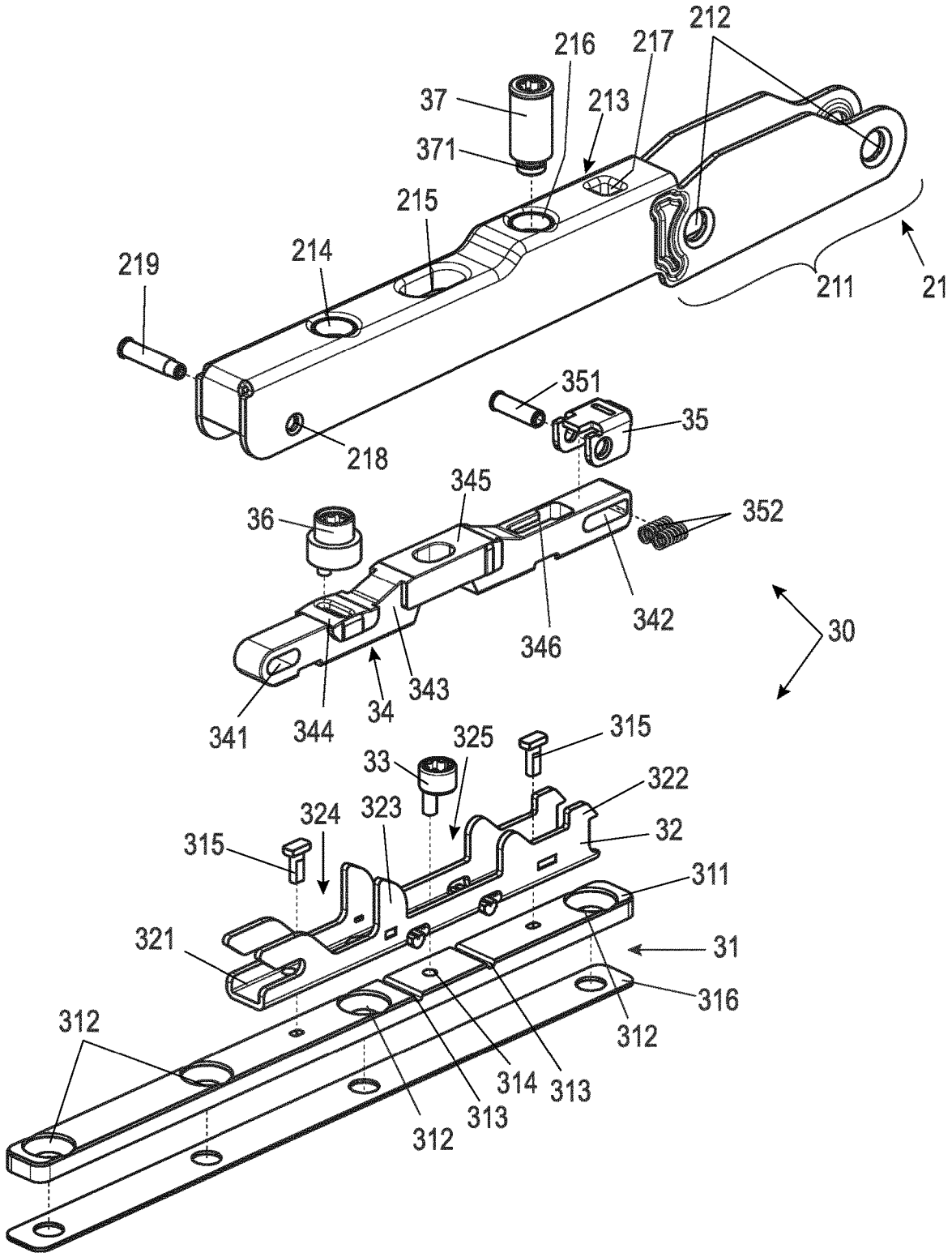
FIG. 5 shows an isometric exploded illustration of a part of the flap fitting of the first exemplary embodiment having an adjustment unit.
Figure 6:
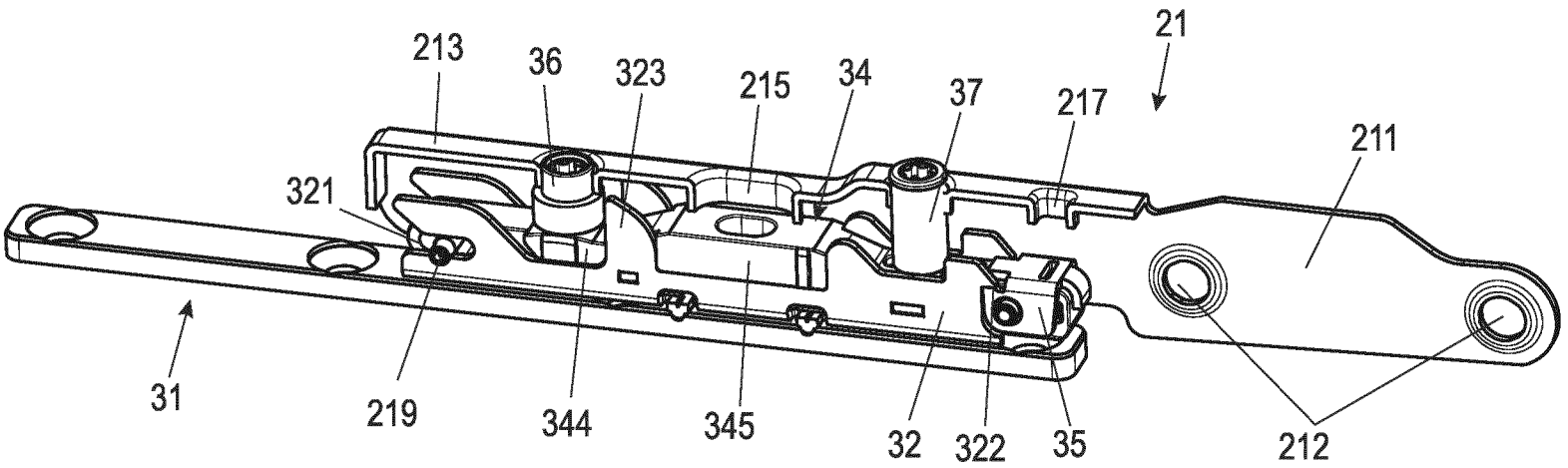
FIG. 6 shows a sectional view of the part of the flap fitting according to FIG. 5.
Figure 7:
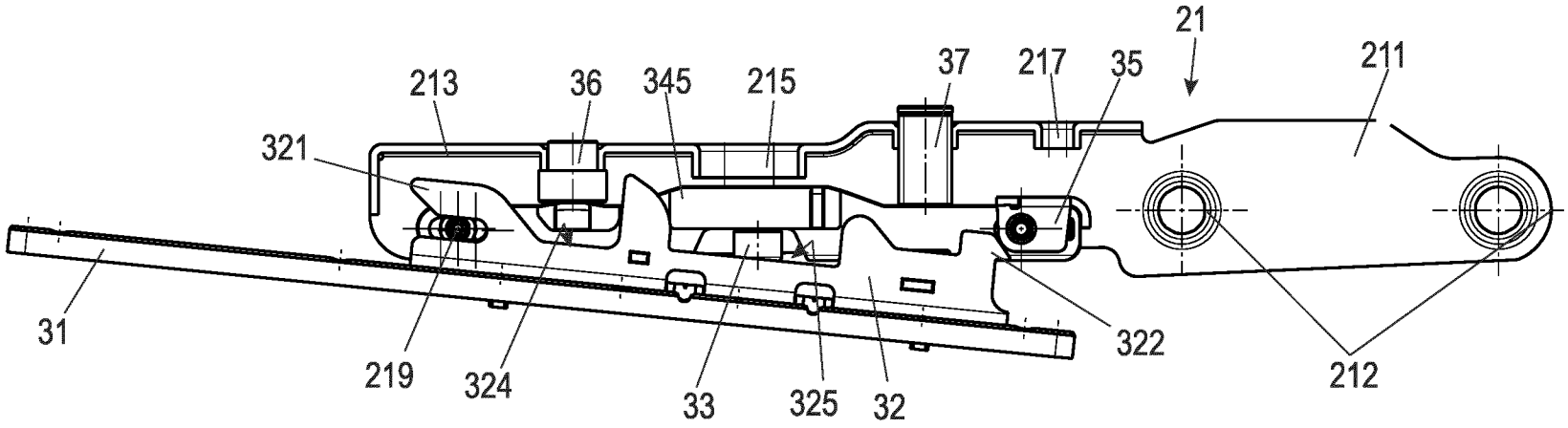
FIG. 7 shows a sectional view according to FIG. 6 during the attachment of an installation plate.
Figure 8A:
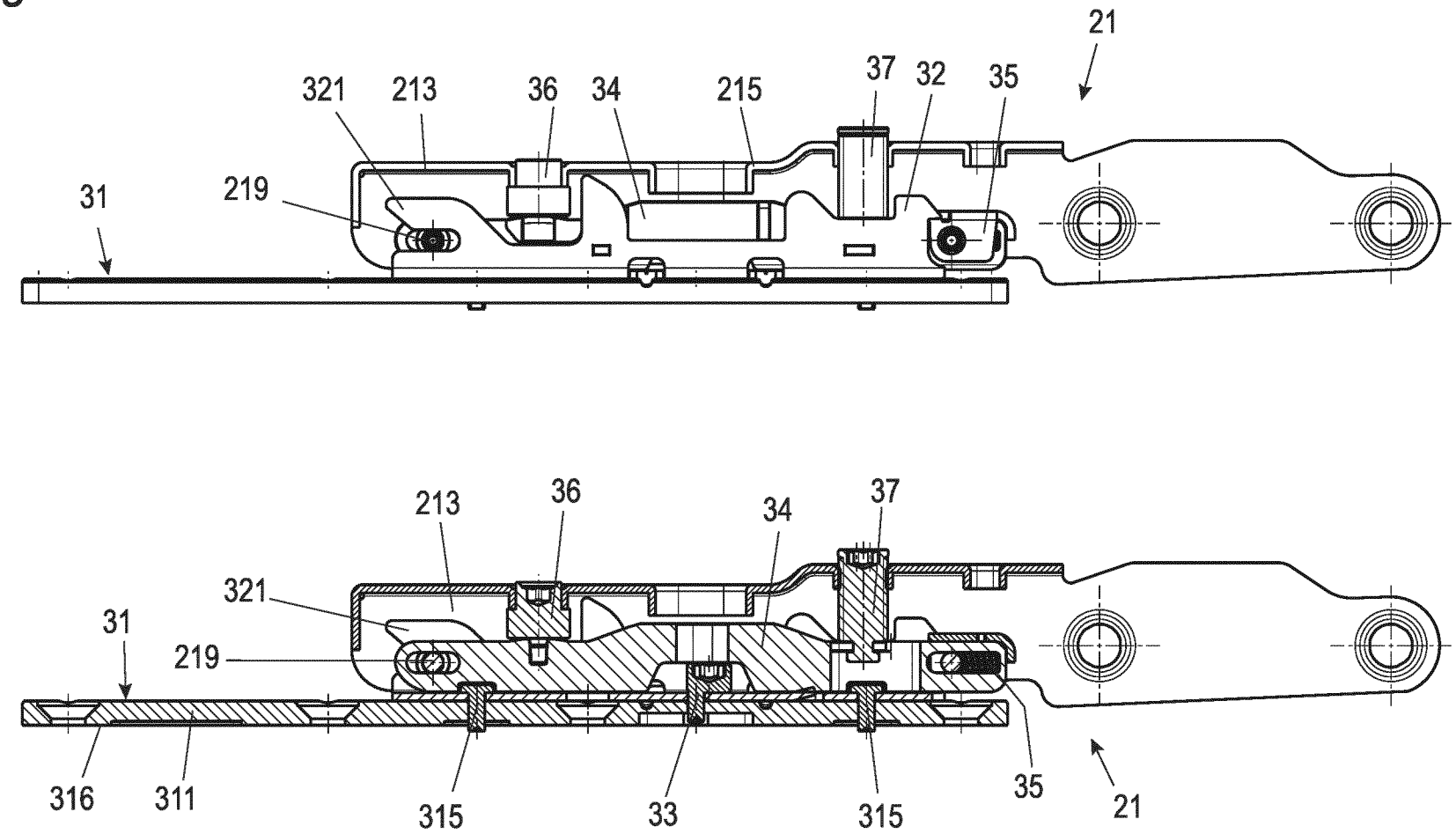
Figure 8B:
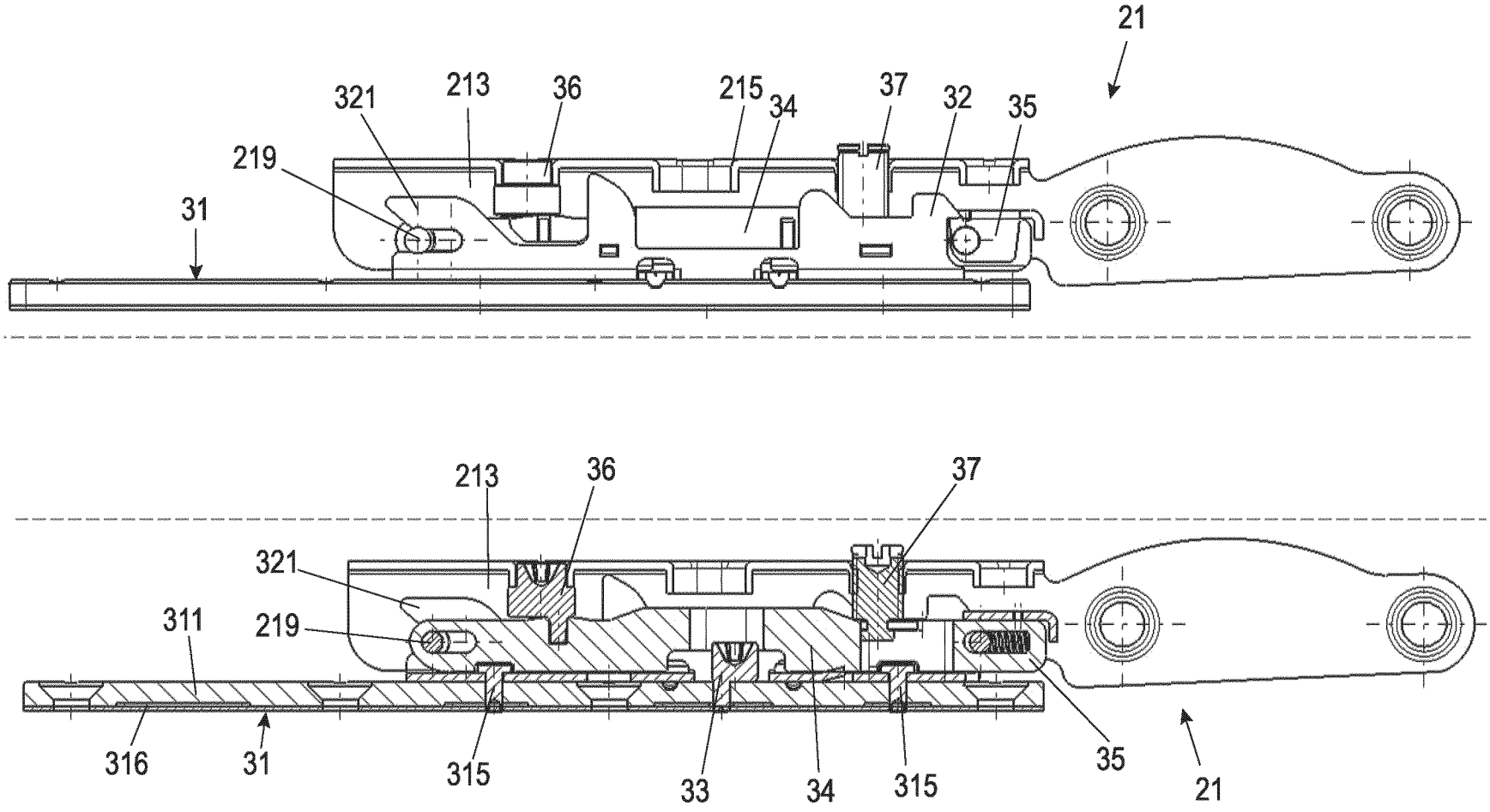
Figure 8C:
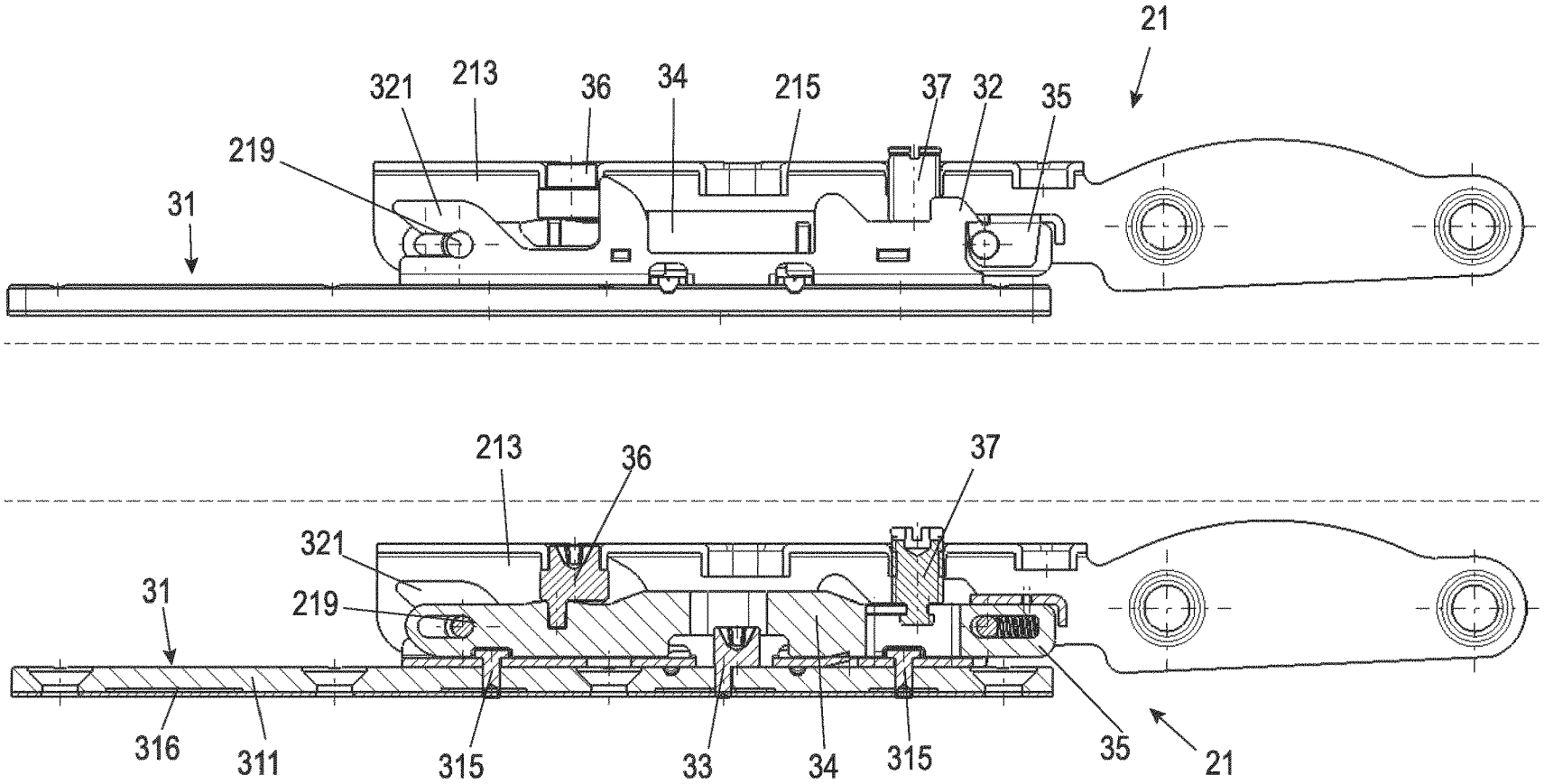
Figure 9A:
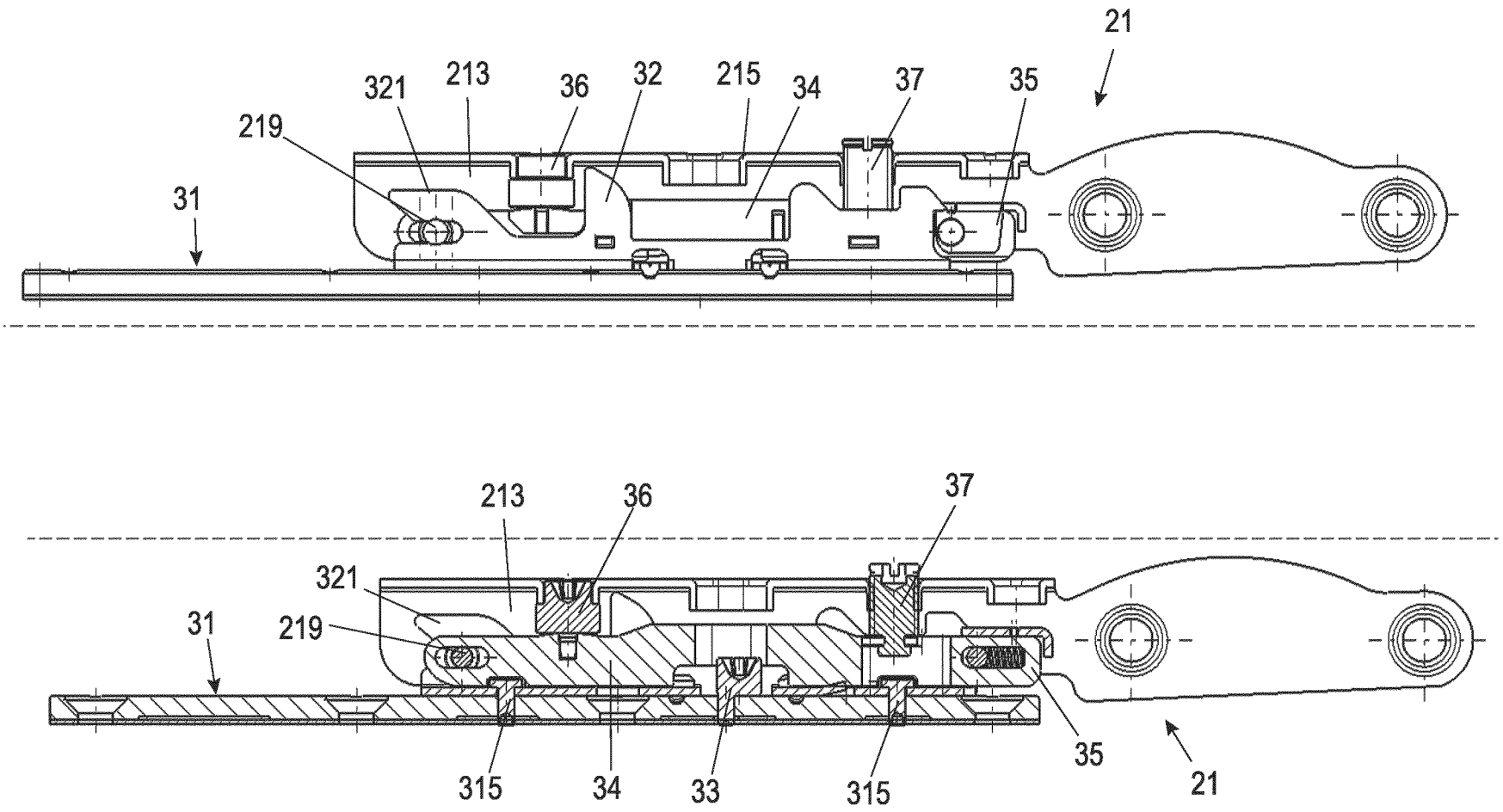
Figure 9B:
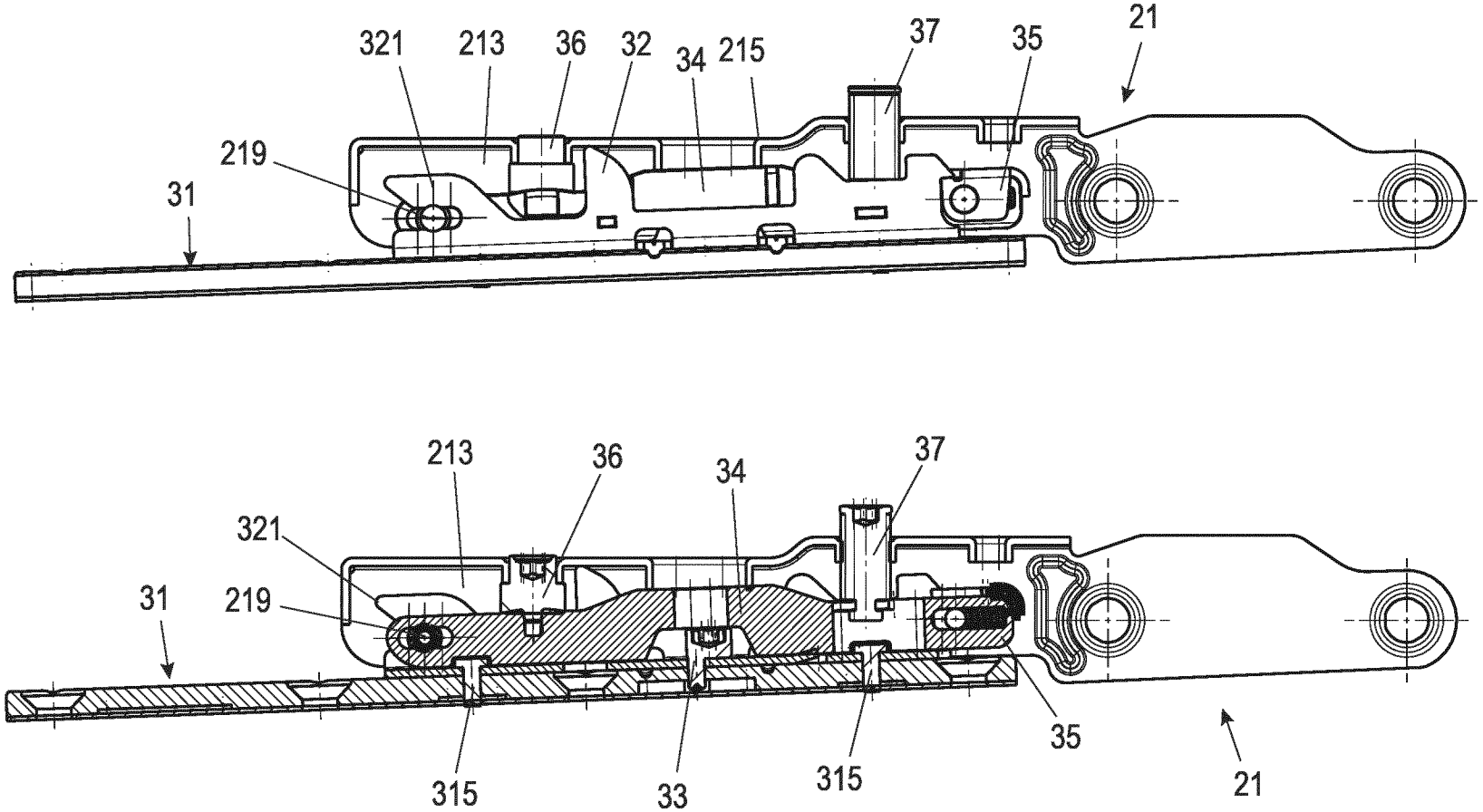
Figure 9C:
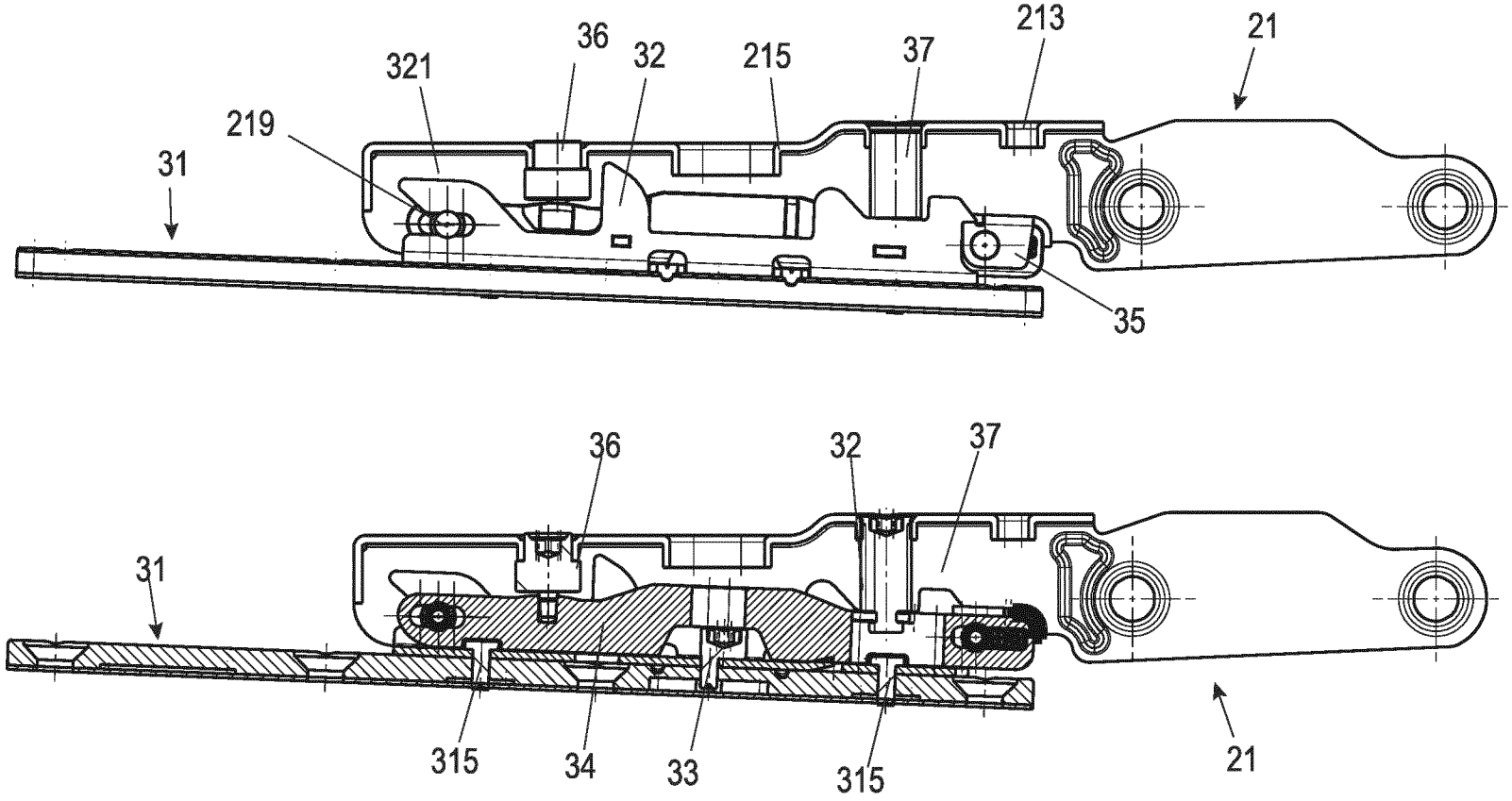
Figure 10A:
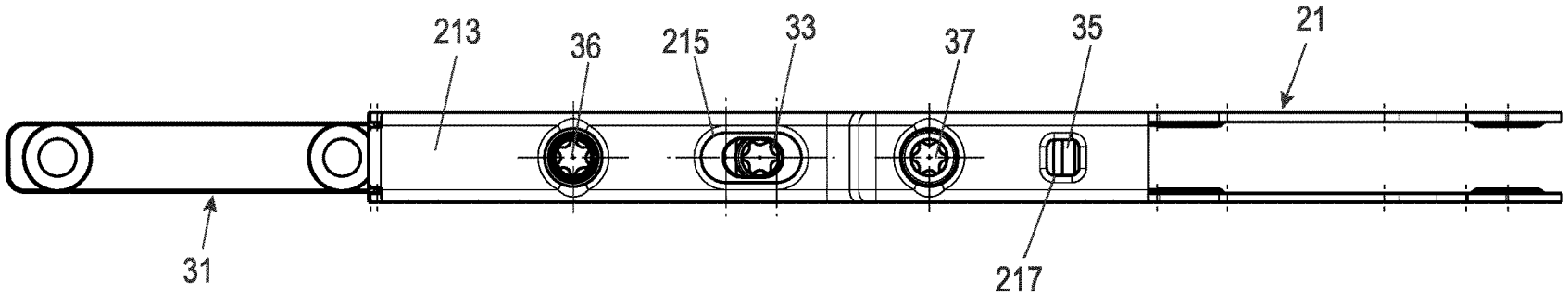
Figure 10B:
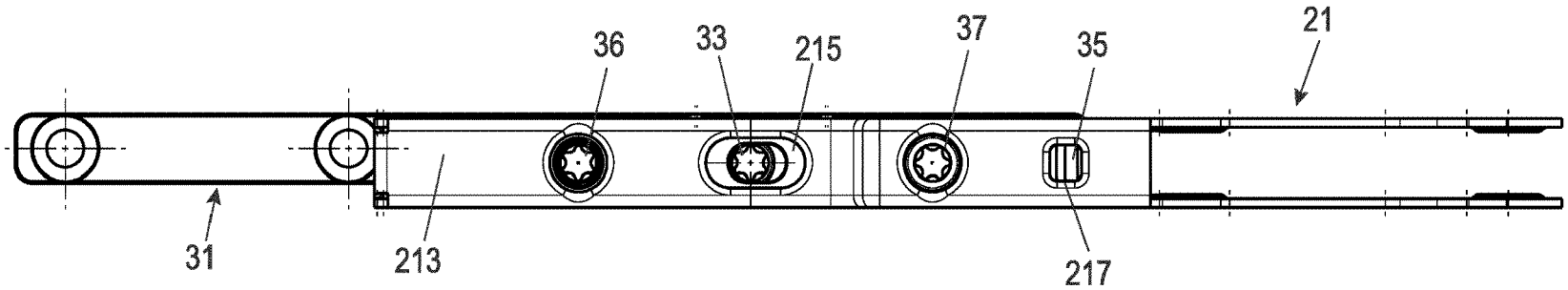
Figure 10C:
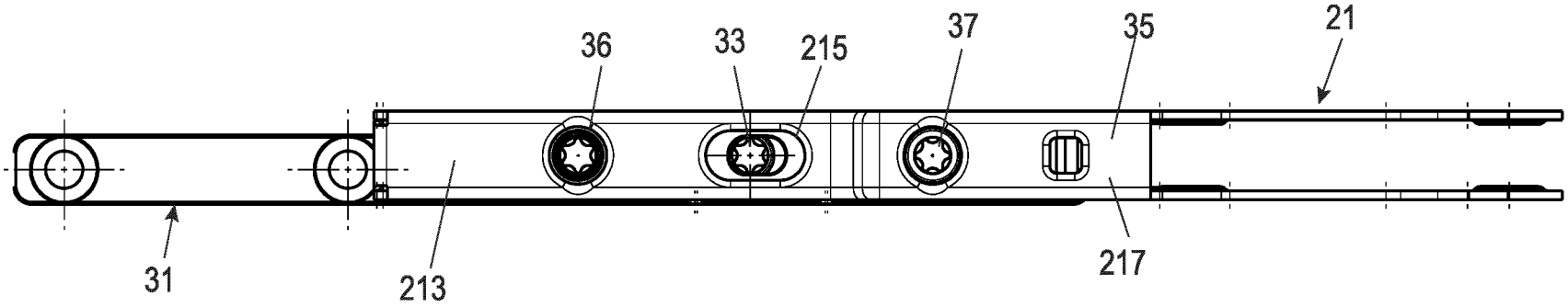
Figure 11:
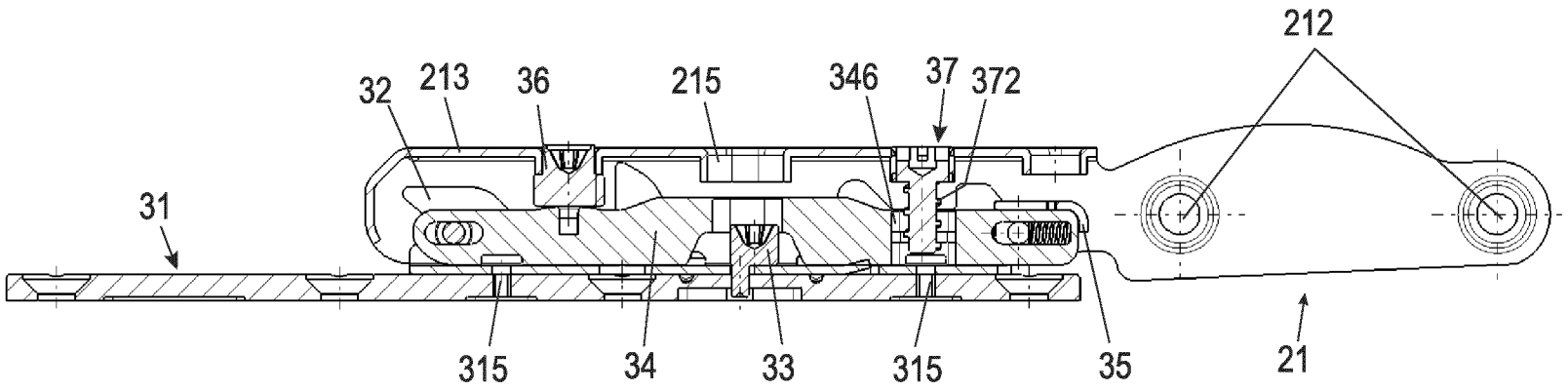
Figure 12:
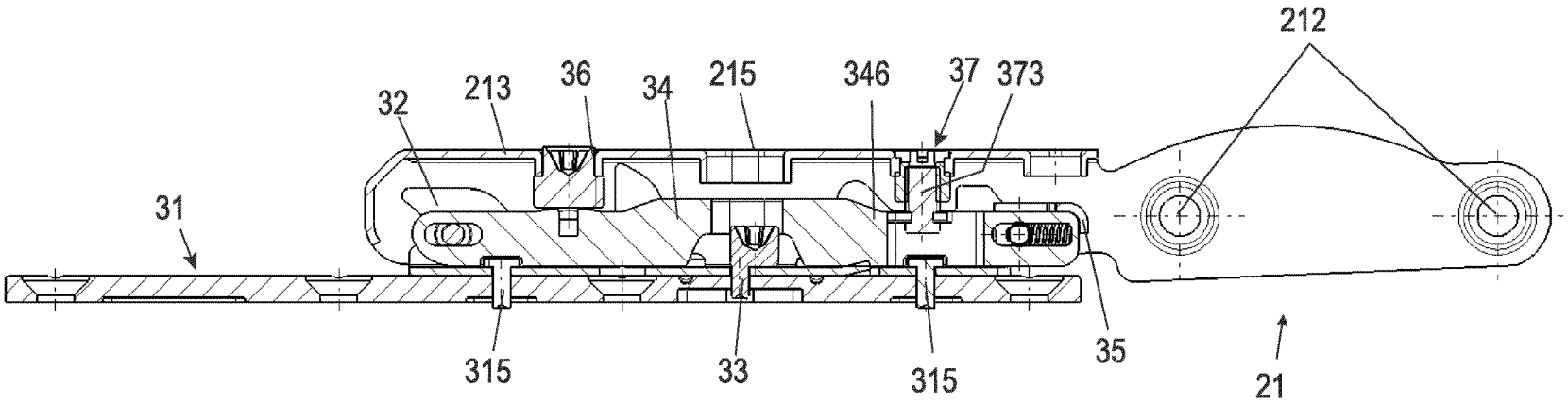

FIGS. 8*a-c* each show a side view having components in partial section (top) and a sectional view (bottom) of the units according to FIGS. 5-7 in various settings of the longitudinal adjustment unit;

FIGS. 9*a-c* each show a side view having components in partial section (top) and a sectional view (bottom) of the units according to FIGS. 5-7 in various settings of the inclination adjustment unit;

FIGS. 10*a-c* each show a side view having components in partial section (top) and a sectional view (bottom) of the units according to FIGS. 5-7 in various settings of the lateral adjustment unit; and FIGS. 11, 12 each show a sectional view of door bearing lever, adjustment unit, and installation plate of a flap fitting in a further exemplary embodiment in each case.

DETAILED DESCRIPTION

Figure 1A:
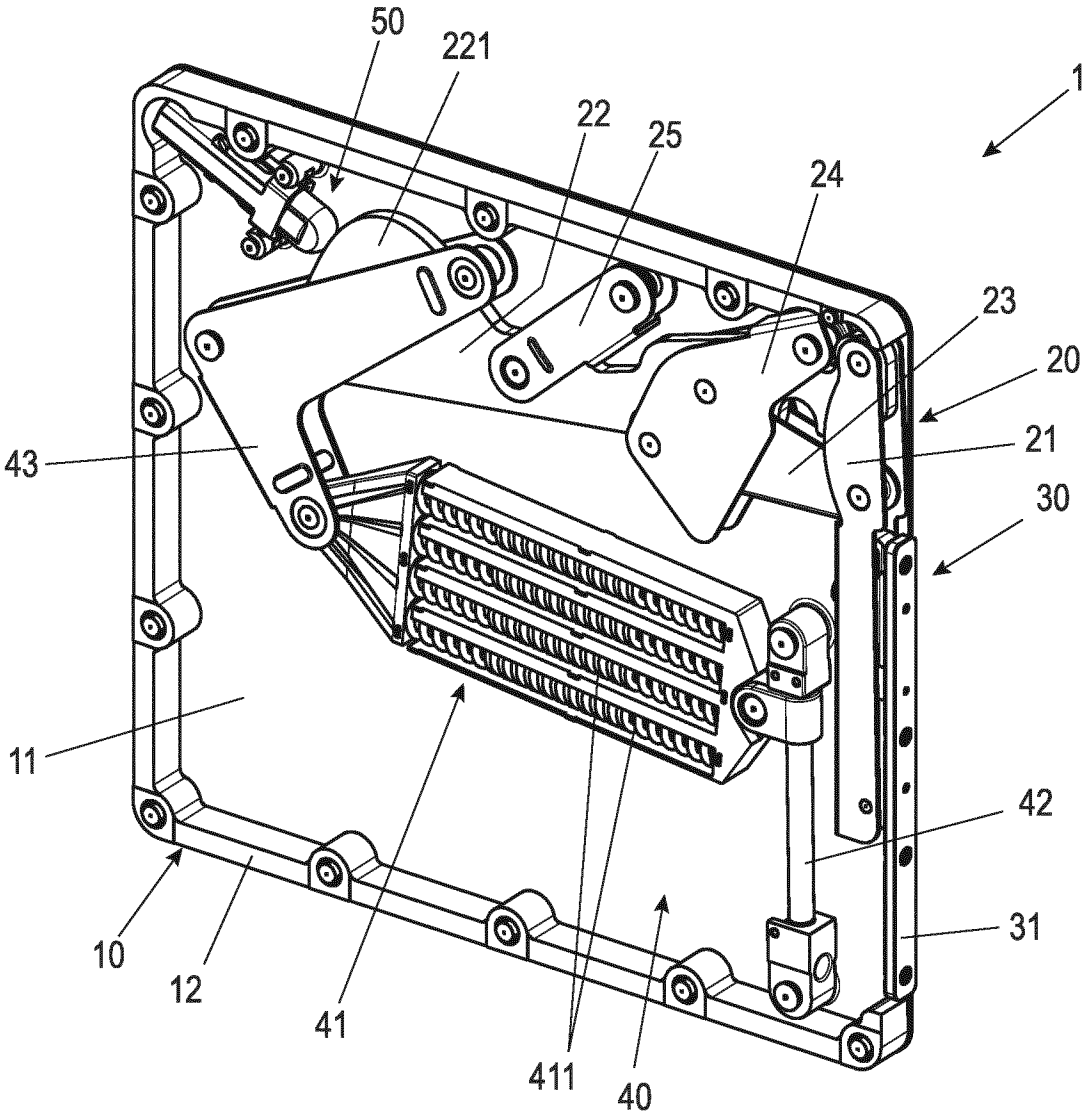
Figure 1B:
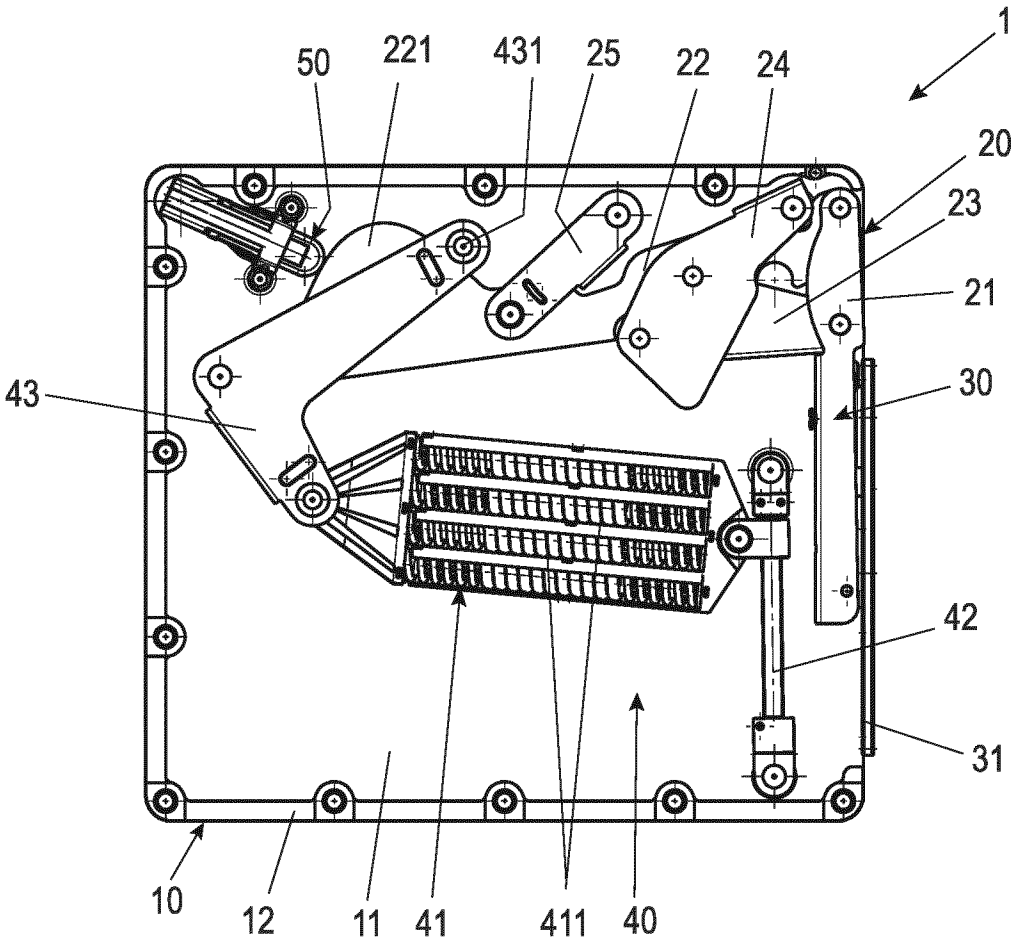
Figure 2A:
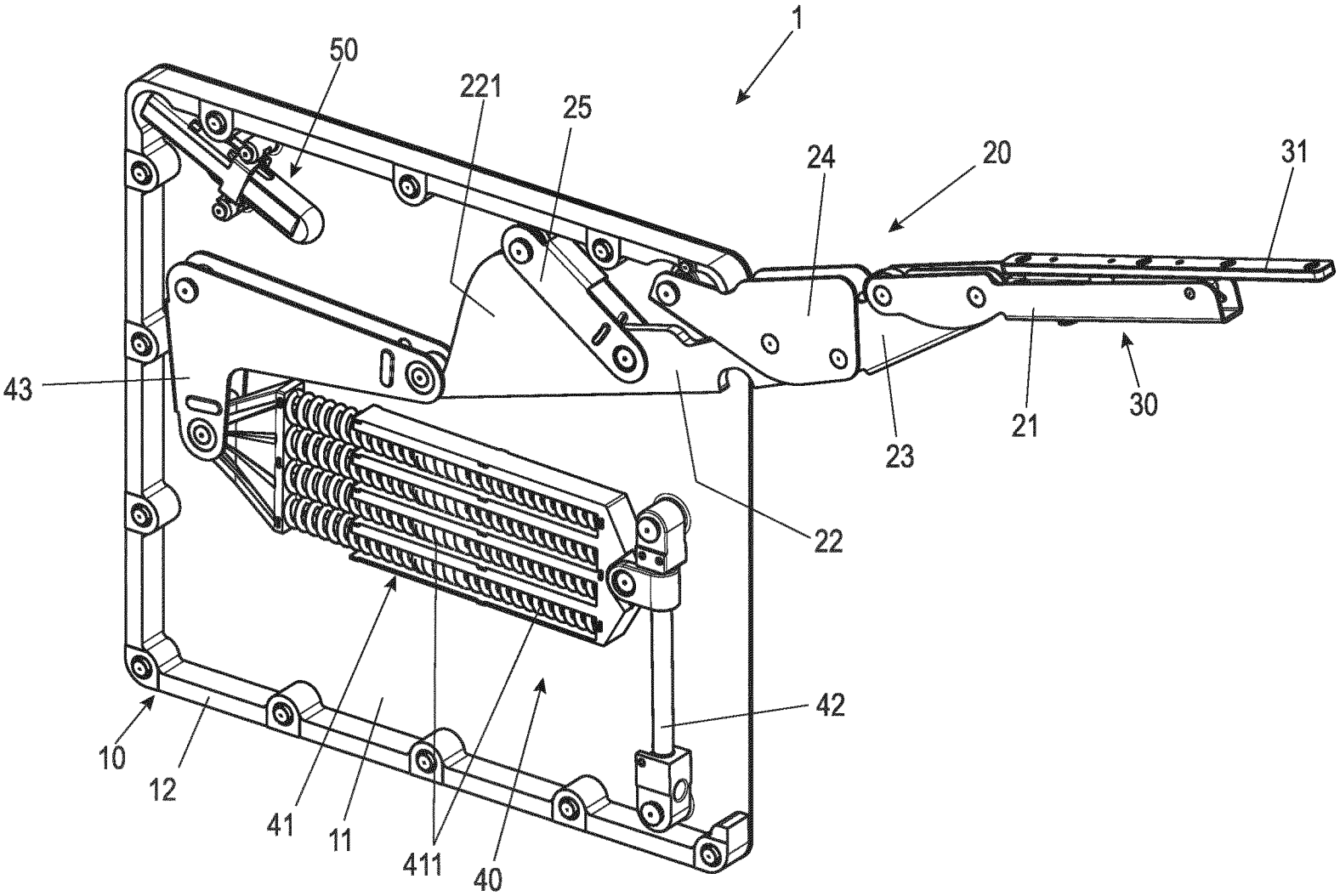
Figure 2B:
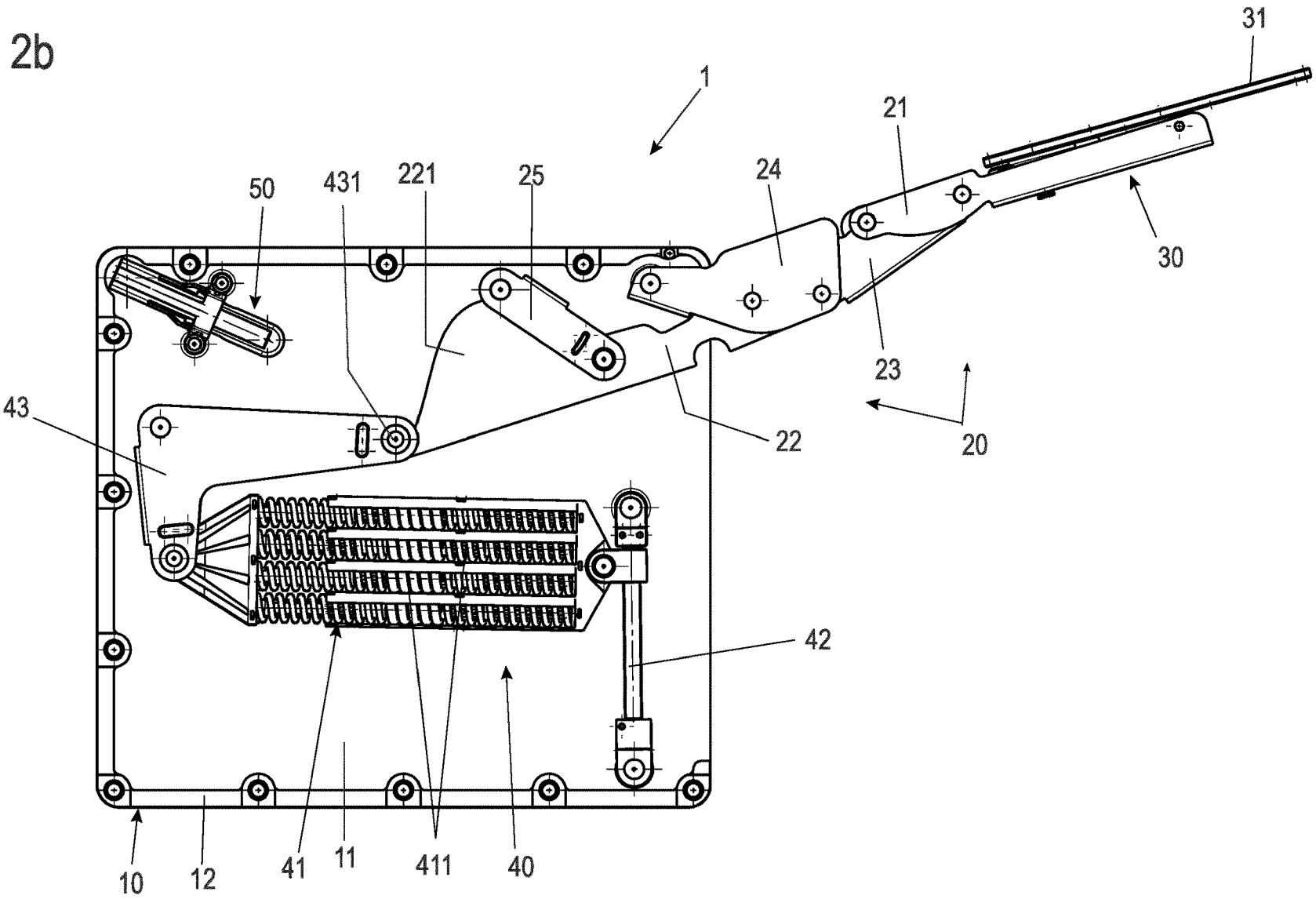

A first exemplary embodiment of a flap fitting 1 is illustrated in a closed position (FIGS. 1*a*, 1*b*) and a completely open position (FIGS. 2*a*, 2*b*) of a flap (not shown here) guided by the flap fitting in FIGS. 1*a* and 1*b* and 2*a* and 2*b*. FIGS. 1*a* and 2*a* show the flap fitting in an isometric illustration and FIGS. 1*b* and 2*b* show it in a side view.

In the description, terms such as top, bottom, left, right refer exclusively to the exemplary illustration selected in the respective figures. The terms front and rear are generally in relation to an opening movement of the guided flap. The front side is a side facing toward the user in this case.

A housing 10 of the flap fitting is shown open on one side in each case to be able to illustrate the internal structure of the flap fitting 1. In all figures, identical reference signs identify identical elements. For reasons of clarity, in the figures, not every element is provided with a reference sign in all figures.

The housing 10 is formed in the present case from two side plates 11, of which only the rear one is shown in the figures, which are spaced apart from one another and aligned in parallel to one another by a partial circumferential frame 12. A plurality of rivets 13 (cf. FIGS. 3*a*, 3*b*), using which the housing 10 and thus the flap fitting 1 is held together, lead through the side plates 11 and the frame 12. Instead of the rivets, other fastening means, for example, screws, can also be used. In the illustrated flap fitting 1, all further components are fastened on the side plates 11, for example, also using rivets or bolts which lead through one or both of the side plates 11.

The flap fitting 1 comprises a lever mechanism 20 having five levers and/or arms, which are connected to one another and/or to the housing 10 in seven points of articulation. The flap fitting 1 is thus designed as a seven-joint mechanism. The lever mechanism 20 comprises a door bearing lever 21 as the outermost element of the lever mechanism 20, which is connected via an adjustment unit 30 to an installation plate 31. The flap to be guided by the flap fitting 1 is installed on this installation plate 31. The adjustment unit 30, which is illustrated in greater detail in following figures, enables an adjustment movement of the installation plate 31 and thus of the guided flap in relation to the door bearing lever 21.

The door bearing lever 21 is rotatably connected to a transmission lever 22 at the upper point of articulation in FIGS. 1*a*, 1*b*. The door bearing lever 21 is connected to a deflection lever 23 in a lower point of articulation in the figures. The deflection lever 23 and the transmission lever 22 are in turn linked to a control lever 24. The transmission lever 22 is connected at its rear end to a support arm 25, wherein the support arm is in turn rotatably mounted on the housing 10. This lever mechanism 20 thus results in a seven-joint chain.

As is apparent from FIGS. 2*a* and 2*b*, the individual levers and/or arms of the lever mechanism 20 are shaped in such a way that they form an approximately stretched arrangement in the open position of the flap. During the opening or closing procedure, the outer element of the lever mechanism 20, the door bearing lever 21, executes a combined rotational and translational movement, by which an installed flap is not only pivoted, but rather is moved forward in such a way that it can be guided with its edge over a body edge. In this manner, for example, the entire opening of the furniture body becomes accessible.

The flap fitting 1 furthermore comprises a spring unit 40, which holds the flap in a spring-loaded manner both in the closed and also in the completely open state. In particular in the completely open state, the spring unit 40 is capable of compensating for the weight of the flap, so that it remains in the open position without a further locking lever.

The spring unit 40 comprises a spring assembly 41 having a plurality of compression springs 411. A right side of the spring assembly 41 in the figures is mounted on a spindle unit 42 so it is adjustable in its position. A side of the spring assembly 41 on the left in the figures acts on a shorter end of an angled intermediate lever 43, which is formed as a two-sided lever and is pivotably fastened on the housing 10. A pressure roller 431, which acts on a control section 221 of the transmission lever 22, is attached to the end of the second, free lever arm of the intermediate lever 43.

The control section 221 extends in a cup shape at its edge having a rising flank (left side of the control section 221 in the figures) and a falling flank (right side of the control section 221 in the figures). When the pressure roller 431 presses against the falling flank, a pressure of the pressure roller 431 has the result of moving the lever mechanism 20 in the direction of the closed position. The installed flap is accordingly pressed closed and/or held closed. During the opening movement, a dead center is passed through when the pressure roller is located just at the tip of the control section 221. In the further course of the opening movement, the pressure roller 431 presses against the rising flank of the control curve, wherein the pressure of the pressure roller 431 has the result of moving the lever mechanism 20 further in the direction of the opening position. The opening movement is correspondingly assisted, and the flap is held in the open position.

The suspension point of the spring assembly 41 can be moved by means of the spindle unit 42 and the pre-tension of the compression springs 411 can thus be varied to adapt the contact pressure force of the pressure roller 431 to the weight and the size of the flap.

Furthermore, a damping unit 50 is provided, in the present case a linear damper operating as a compression damper, against which a section of the transmission lever 22, specifically a part of the control section 221 of the transmission lever 22 here, strikes to decelerate the lever mechanism 20 as it approaches the closed state.

In principle, the damping unit 50 could also be arranged at another point inside the housing 10 and could act on another lever or arm of the lever mechanism 20 to decelerate an approach of the flap to one of the end positions (closed/open) and thus damp it. In one refinement, two independent damping units 50 can also be provided, of which one performs a closing damping and the other performs an opening damping.

Figure 3A:
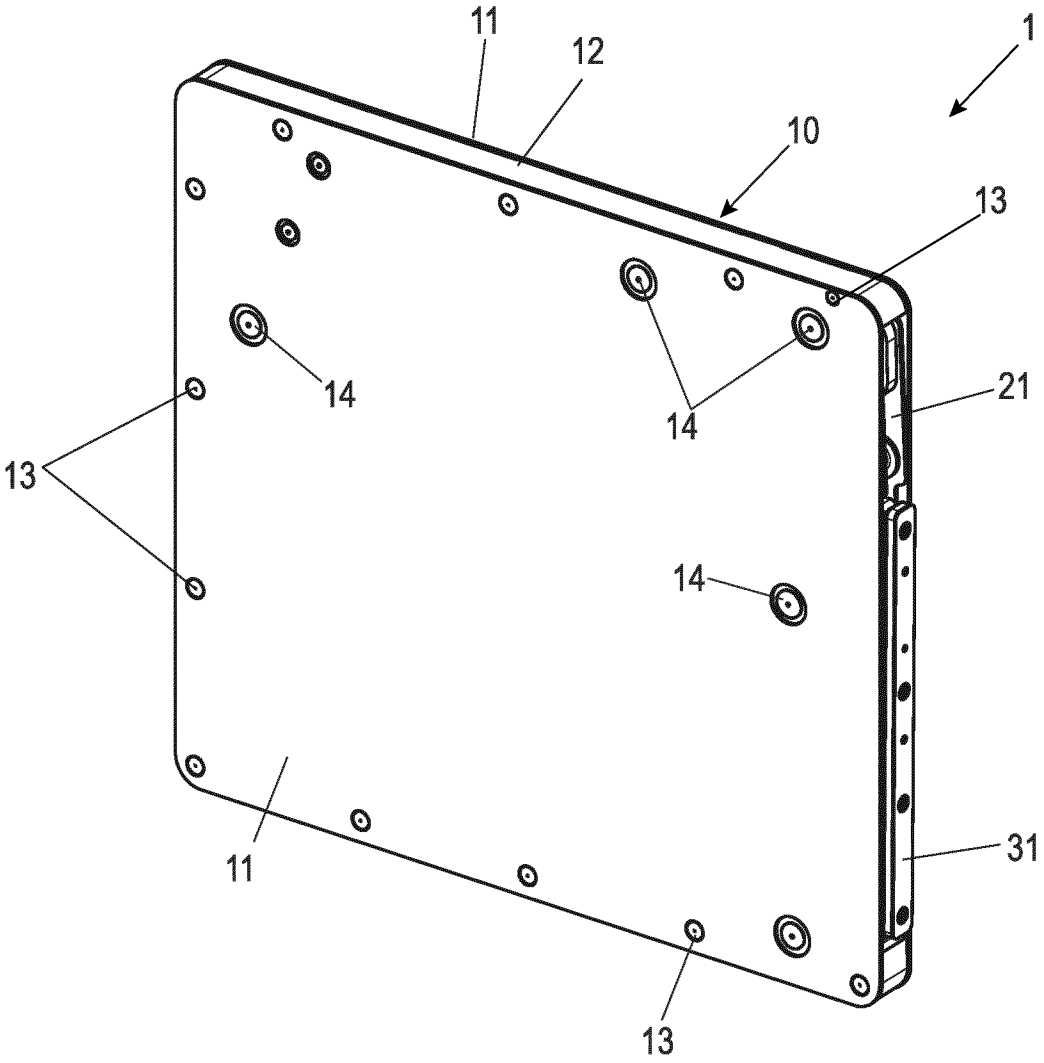
Figure 3B:
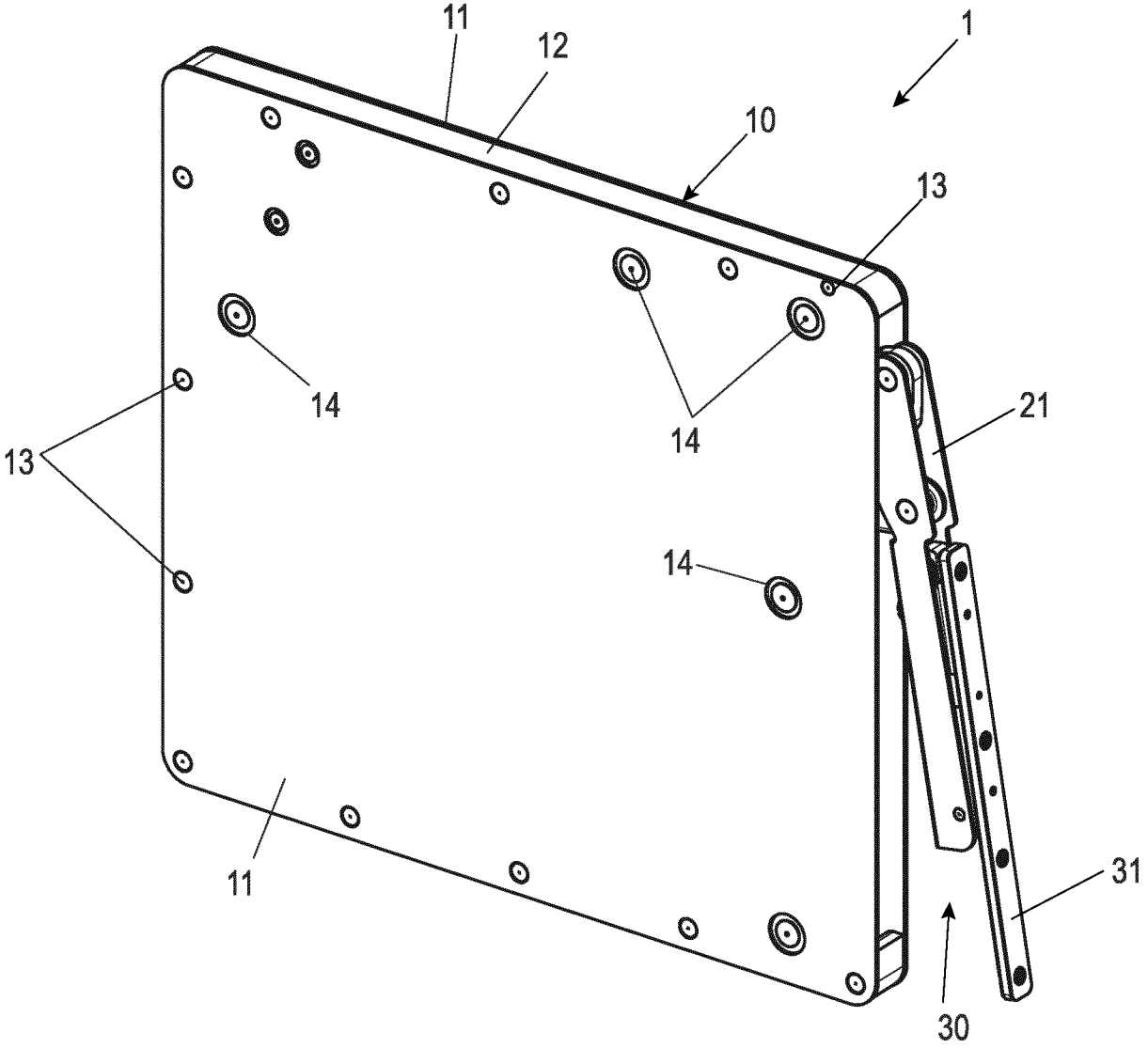

An isometric view of the flap fitting of FIGS. 1*a* to 2*b* having closed housing 10, i.e., having attached second side plate 11, is shown in FIGS. 3*a* and 3*b*. FIG. 3*a* shows the flap fitting in a closed state of an installed flap (not visible here) and FIG. 3*b* shows a partially open state, wherein the opening angle is approximately 10°.

The housing 10 is closed in the region of the frame 12 by the above-mentioned rivets 13. It is obvious that instead of the rivets 13, other connecting elements can be used for closing the housing 10, for example, screws. Alternatively, closing of the housing can also be performed by an adhesive bond between the side plate 11 and the frame 12.

Further rivets 14 are used for installing joint axes or other components of the flap fitting 13 on one or preferably both side plates 11. These further rivets 14 additionally close the housing 10, are used as spacers for the side plates, and thus stabilize the housing 10.

In particular, FIG. 3*a* shows that in the closed position of the flap fitting 1, the entire lever mechanism 20 including the adjustment unit 30 retracts between the side plates 1.

Figure 4:
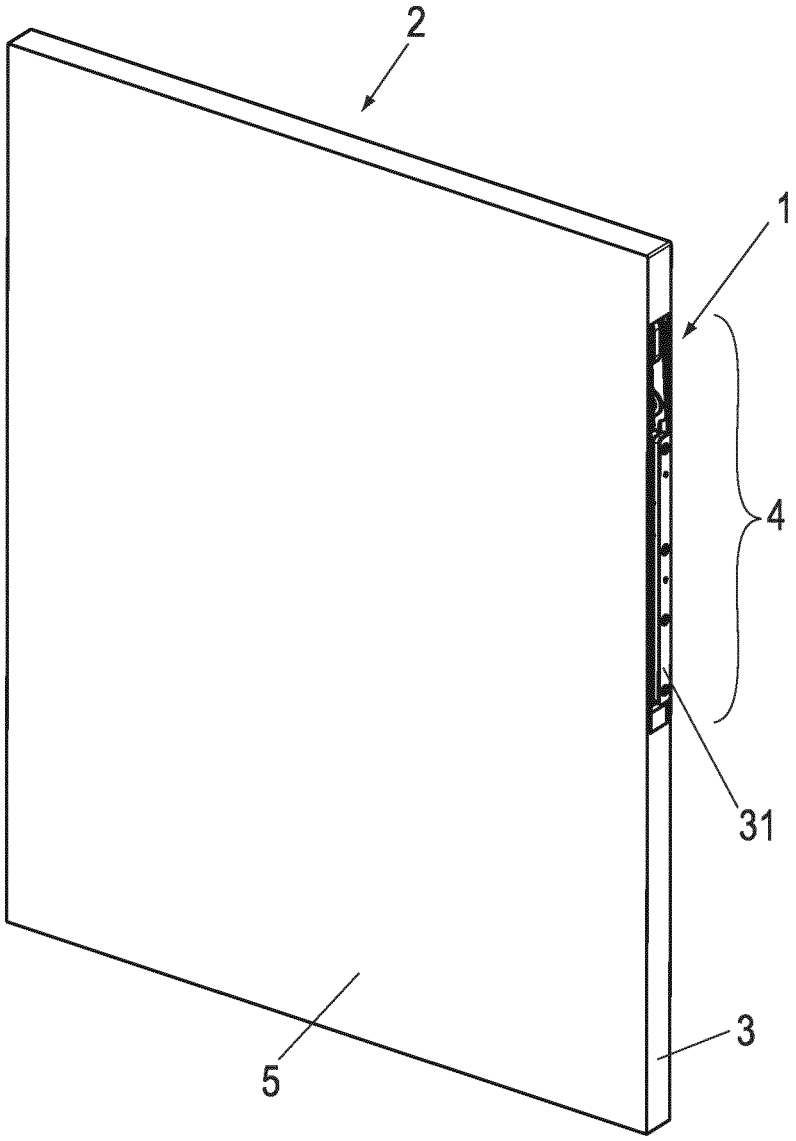
FIG. 4 shows a side wall of a furniture body having an integrated flap fitting in an isometric view.

A side wall 2 of a furniture body (not shown in greater detail) is shown in FIG. 4, in which a flap fitting 1 according to the application, for example, as shown in FIGS. 1*a* to 3*b*, is integrated. A furniture body generally comprises at least two such side walls 2, wherein a corresponding flap fitting 1 according to the invention is integrated in both of them. The two—or possibly further flap fittings 1, which are integrated into intermediate walls of the furniture body—support a flap closing the furniture body to the front.

An opening 4, through which the lever mechanism 20 of the flap fitting 1 extends, is formed in a front end face 3 of the side wall 2. The flap fitting 1 is inserted into the side wall 2 through the opening 4 into a receptacle formed behind this opening, is already integrated into the side wall 2 during the production thereof or is inserted laterally through a pocket, which is introduced from a side surface 5 and comprises an opening 4 on the end face 3. In all cases, the flap fitting 1 is integrated into the side wall 2, wherein at least in the first two cases, the flap fitting is covered on its sides by side surfaces 5 of the side wall 2 and is therefore not visible from the outside or from the inside of the furniture body. It is essential here that the flap fitting 1 and the side wall 2 form a unit, and the side wall 2 having inserted flap fitting has no or almost no thickness difference.

In order to be integrated into the side wall 2 of the furniture body, the thickness of the flap fitting 1, i.e., the outer spacing of the side plates 11, is strongly restricted by specifications with respect to the wall thickness of the furniture body. In the case of typical side walls of furniture bodies having a thickness of 16 mm (millimeter), the thickness of the flap fitting 1 is necessarily less than 16 mm and is preferably less than or equal to 14 mm. The lever mechanism 20 including the adjustment unit 30 having an installation profile 32 (cf. FIG. 6) is accordingly designed in such a way that it can be retracted between the two side plates 11 which have this spacing.

FIG. 5 shows the door bearing lever 21 having the adjustment unit 30 separately from further components of the flap fitting in an isometric exploded illustration.

The door bearing lever 21 comprises a joint section 211, in which the points of articulation of the lever mechanism 20 and the seven-joint hinge thus formed are arranged in bearing boreholes 212. A U-shaped support section 213, to which the installation plate 31 is adjustably connected and which is thus already part of the adjustment unit 30, adjoins the joint section 211. The door bearing lever 21 is preferably formed as a stamped-bent part. The U-shaped support arm section 213 is also referred to hereafter as an outer profile 213 of the adjustment unit 20.

An adapter 34 of the adjustment unit 30 is inserted into the outer profile 213. The adapter 34 is preferably a molded part, for example, produced in a metal casting method. The adapter 34 comprises an oblong hole 341, through which a bolt 219 is guided, which is secured in boreholes 218 in the legs of the outer profile 213, on its front end, facing away from the joint section 211 of the door bearing lever 21. The adapter 34 is narrower than the inner spacing of the two legs of the outer profile 213, so that a lateral movement is possible. The adapter 34 can also be moved in the longitudinal direction inside the outer profile 213 through the oblong hole 341. Such a movement in the longitudinal direction corresponds, in the case of an attached flap, to a vertical adjustment of the flap in the closed state.

A second bearing point for the adapter 34 in the outer profile 213 is given by an inclination adjustment screw 37. The inclination adjustment screw 37 is provided in the illustrated exemplary embodiment with an external thread on its head and is screwed into a corresponding receptacle 216 on the outer profile 213. The receptacle 216 is accordingly equipped with an internal thread in the exemplary embodiment. On its lower end, which leads during the screwing in, the inclination adjustment screw 37 is provided with a circumferential groove 371, which engages in a correspondingly shaped coupling section 346 on the adapter 34. The coupling section 346 is formed like a keyhole receptacle, so that with corresponding position of the adapter 34, it can be placed on the inclination adjustment screw 37 and after pushing back, lateral webs on the coupling section 346 are positioned in the groove 371 of the inclination adjustment screw 37. During the assembly, this connection is firstly established and then the bolt 219 is inserted through the oblong hole 341 and the rivet borehole 218. After the assembly, by pivoting the adjustment screw 37, the adapter 34 can be varied in its height in the rear region within the U-shaped outer profile 213. The inclination adjustment screw 37 can be subjected to friction force in its mounting in this case, so that unintentional adjustment is avoided, and self-inhibiting is provided. Since the front end with regard to its height inside the U-shaped outer profile 213 is defined by the bolt 219 and/or the oblong hole 341, an inclination of the adapter 34 in relation to the door bearing lever 21 is accordingly achieved by pivoting the inclination adjustment screw.

Moreover, a coupling section 344 for a vertical adjustment is formed in the front region of the adapter 34. This coupling section 344 comprises an oblong hole oriented transversely in the adapter 34, in which an eccentrically arranged driver pin of a longitudinal adjustment eccentric 36 engages. The longitudinal adjustment eccentric 36 is rotatably mounted in a corresponding receptacle 214 on the outer profile 213. The longitudinal adjustment eccentric 36 is formed, for example, as a wobble rivet and is deformed during the insertion into the receptacle 214 in such a way that it is rotatably mounted with a certain friction lock for self-inhibiting in the outer profile 213. Pivoting of the longitudinal adjustment eccentric 36 results in a longitudinal movement of the adapter 34 inside the outer profile 213, to which a vertical adjustment of an installed flap is linked, as already explained.

A further oblong hole 342, through which a bolt 351 is guided, is formed at the rear end of the adapter 34. Furthermore, an essentially U-shaped bent catch slide 35 on the adapter 34 is installed on the bolt, which encloses the adapter 34 from the top and on the sides in the rear region. Moreover, at least one spring 352, in the present case two springs 352 by way of example, is arranged in the oblong hole 342. The springs 352 are formed as compression springs and act on the edge of the oblong hole and the bolt 351. They push the catch slide 35 toward the front end of the adapter 34. The catch slide 35, the function of which is explained hereafter, is accessible through an access opening 217 in the outer profile 213 and can be pushed back by using a corresponding tool, for example, a screwdriver.

The adapter 34 having the catch slide 35 form a coherent unit together with the door bearing lever 21. A second unit is formed by the installation plate 31 and an installation profile 32 connected thereto. This unit is screwed onto the flap to be moved. The flap having the screwed-on installation plate 31 and/or the installation profile 32 can then be suspended in a simple and convenient manner on the door bearing lever 21 and locked with it. The locked state of the unit made of installation plate 31 and installation profile 32 with the door bearing lever 21 and the adapter 34 is shown in FIG. 6. This figure shows an isometric view of the assembled units, wherein the outer profile 213 is shown in partial section to illustrate the connection of the two units. FIG. 7 shows the procedure of connecting the two units in an intermediate stage in a side view, in which the outer profile 213 is also shown in partial section.

The construction and the functionality of the second unit made of installation plate 31 and installation profile 32 can be seen well again in the exploded illustration of FIG. 5 in the lower part of the figure.

The installation plate 31 is constructed in two parts in the present case and comprises an installation rail 311 and an intermediate layer 316 (not shown here), which is optionally underlying in principle here. The intermediate layer 316 is produced, for example, from a plastic and is used in particular in the case of flaps made of glass. It then prevents a direct contact between the installation rail 311, which is generally manufactured from metal, and the glass. In particular in the case of flaps made of wooden materials, it is also conceivable to apply the installation rail 311 directly without the intermediate layer 316.

Installation boreholes 312, using which the installation plate 31 is screwed onto the corresponding flap, lead through the installation rail 311 and intermediate layer 316. The installation profile 32, which is preferably again manufactured as a stamped-bent part having a U-shaped profile, is attached to the installation plate 31, wherein a base of the U-shaped installation profile 32 rests on the installation plate 31 and two identically formed legs protrude perpendicularly from the installation plate 31. The installation profile 32 is fastened with the aid of hammer rivets 315 on the installation plate 31, in particular on the installation rail 311. The hammer rivets 315 are guided in the installation profile 32 through oblong holes extending transversely to the longitudinal direction of the installation profile 32, so that the installation profile 32 is displaceable transversely on the installation plate 31.

To guide this transverse movement and to force a parallel movement of the installation profile 32 in relation to the installation plate 31, guide profiles 313, in which correspondingly embodied webs on the lower side of the installation profile 32 move, extend transversely in the installation plate 31.

The two legs of the installation profile 32 are provided in their lower end (again in relation to the alignment upon installation on a vertical flap) with outwardly open longitudinal slots 321. Using these longitudinal slots 321, the installation profile 32 is applied to the bolt 219, wherein the adapter 34 is enclosed by the legs of the installation profile 32.

The application of the installation profile 32 to the bolt 219 can be seen in FIG. 7. After the application, the upper side (again in relation to the installation situation) of the installation profile 32 is pivoted in, wherein catch lugs 322 formed on this side lock behind the catch slide 35 (cf. FIG. 6). By simple hanging and pivoting in, a correspondingly prepared flap is thus installed on the door bearing lever 21 and therefore on the furniture body. For removal, the catch slide 35 can be pushed back through the access opening 217 using a corresponding tool, whereby the locking with the catch lugs 322 is canceled out and the installation profile 32 and thus the installation plate 31 and/or the flap can be pivoted out and removed.

In this meaning, the installation plate 31 forms a part of the flap, while in contrast the installation profile 32 is to be associated with the adjustment unit 30. During the closing of the flap, the adjustment unit 30 retracts between the side plates 11 of the flap fitting 1. The installation plate 31 is located in front of the side plates 11. If the flap fitting 1 is inserted in a side wall 2 of a furniture body (as shown in FIG. 4), a part of the installation plate 31 can still be located in the region of the side wall 2, for example, between cap strips or edge strips, which are applied adjacent to the opening 4 on the end face 3. A possibly remaining structural height of the installation plate 31 is less than one or a few millimeters and is thus in the range of gap dimensions between the end face 3 and the flap in the closed state.

During the pivoting in of the second unit (installation profile 32 and installation plate 31), protruding drivers 323 of the installation profile 32 engage in the driver section 343 provided for this purpose on the adapter 34, whereby the longitudinal position of the installation profile 32 is fixed in relation to the adapter 34. A longitudinal adjustment of the adapter 34 inside the outer profile 213 is thus transmitted to the installation profile 32. Furthermore, due to the locking of the installation profile 32 on the catch slide 35, the alignment of the installation plate 32 in relation to the adapter 34 is fixed, so that an inclination adjustment of the adapter 34 is transmitted to the second unit.

As mentioned, the installation profile 32 encloses the adapter 34 with its legs. This enclosure takes place without play as much as possible in this case, so that the lateral position of the installation profile 32 is defined by the lateral position of the adapter 34. The adapter 34 comprises regions in which it is wider than in other regions. These regions are the coupling section 344 for the vertical adjustment and also the passage 345 for a lateral adjustment. In these regions, the U-shaped installation profile 32 comprises recesses 324, 325 in the lateral legs, so that the mentioned regions can be wider by the side wall thickness of the installation profile 32 than other regions of the adapter 34, without the adapter 34 protruding laterally beyond the outer dimensions of the installation profile 32. The adapter 34 is thus not completely enclosed by the installation profile 32, but rather only in specific regions, which can be formed narrower because of the design than other regions. In this manner, the smallest possible overall width of the installation profile 32 and the adapter 34 is achieved. A head of a lateral adjustment eccentric 33 is positioned in the passage 345, which head comprises an eccentric driver pin that engages in a coupling borehole 314 on the installation plate 31. The base of the installation profile 32 is omitted in this region by corresponding stamping.

The head of the lateral adjustment eccentric 33 moves precisely between the legs of the installation profile 32 and/or between the side walls of the adapter 34 in the region of the passage 345. Upon pivoting of the lateral adjustment eccentric 33, the head displaces the installation profile 32 in relation to the installation plate 21 to one side or the other during its eccentric movement. The lateral adjustment eccentric 33 moves in this case with its center point in the longitudinal direction of the installation profile 32. Since both the passage 345 and also the oblong hole 215 in the door bearing lever 21 are formed accordingly for the lateral adjustment, a tool, for example, a screwdriver, using which the lateral adjustment eccentric is adjusted, can follow this longitudinal movement. As a result, the installation plate 31 is moved laterally back and forth by pivoting the lateral adjustment eccentric 33, whereby a lateral adjustment of the installed flap can be performed. To hold the lateral adjustment eccentric 33 in the region of the passage 345, it is preferably clinched or riveted with the installation plate 31.

Overall, the adjustment unit 30 shown enables a lateral adjustment (sideways and vertical adjustment independently of one another) and also an inclination adjustment of an installed flap. Moreover, the flap having an installed part of the flap fitting can be disconnected easily from the remaining part of the flap fitting, which simplifies the installation of the flap on the flap fitting 1 and the furniture body.

The function of the adjustment unit 30 is shown once again in FIGS. 8*a-c*, 9*a-c*, and 10*a-c*, by various positions of the longitudinal adjustment being shown, i.e., a vertical adjustment of an installed flap in FIGS. 8*a-c*, the inclination adjustment in FIGS. 9*a-c*, and the lateral adjustment in FIGS. 10*a-c*. In each of the figures, the index a shows a middle position, and the respective one or the other setting in opposing adjustment directions are shown in the figures having the index b or c, respectively. A side view is shown in the upper figure part in each of the figures, wherein the outer profile 213 is shown in section to be able to illustrate the arrangement of the installation profile 32 and/or the adapter 34 inside the outer profile 213. A sectional view along a center plane of the arrangement is shown in the lower part of the figures of FIGS. 8*a-c* and 9*a-c*. FIGS. 10*a-c* each show a top view of the arrangement.

The assembled first and second units, i.e., door bearing lever 21 with adapter 34 and attached installation plate 31 with installation profile 32 of flap fittings, are illustrated in two further exemplary embodiments in FIGS. 11 and 12. The exemplary embodiments differ from the above-described example in the implementation of the inclination adjustment. An inclination adjustment screw 37 is again provided, which is arranged in a corresponding receptacle 216 of the outer profile 213 and the rotation of which results in an angle adjustment between this outer profile 213 and the adapter 34. Both figures are again sections through the units along a center plane.

In the above-described exemplary embodiment, an adjustment of the inclination has the result that the inclination adjustment screw 37 is screwed in or out in relation to the outer profile 213 (cf., for example, FIGS. 9*a-c*). In the exemplary embodiments of FIGS. 11 and 12, the inclination adjustment screw 37 remains having its head flush to the upper side of the outer profile 213, independently of its setting.

According to the exemplary embodiment of FIG. 11, this is achieved in that the vertical adjustment screw 37 is not screwed with an external thread into a thread of the outer profile 213, but rather is rotatably mounted with its head in the outer profile 213. This can be achieved by corresponding contact edges and attachments on the head of the inclination adjustment screw 37.

It is also possible to mount the inclination adjustment screw like a wobble rivet in the outer profile 213. In a shaft region, the inclination adjustment screw 37 comprises an external thread 372 having a large thread height. The inclination adjustment screw 37 engages using this external thread 372 in the receptacle 346, which is formed slotted as before. The receptacle 346 thus forms a type of thread, in which the external thread 372 of the inclination adjustment screw 37 engages, wherein the receptacle 346 can still be displaced in the longitudinal direction of the adapter 34.

In the exemplary embodiment of FIG. 12, the inclination adjustment screw 37 is formed in two parts and comprises a head part, which is rotatably mounted in the outer profile 213 as in the exemplary embodiment of FIG. 11. This can again be performed by corresponding contact edges and/or clinching. The inclination adjustment screw 37 comprises as a second part a threaded sleeve 373, which is guided with lateral cuts in a twist-locked manner in the also slotted receptacle 346. In an upper section, the threaded sleeve 373 comprises an internal or external thread, which interacts with a corresponding external or internal thread on the head of the inclination adjustment screw 37. Pivoting the head of the inclination adjustment screw 37 moves the threaded sleeve 373 downward and upward, which in turn changes the inclination of the adapter 34 in relation to the outer profile 213.

The lever mechanism 20 is embodied here in this exemplary embodiment of FIGS. 1 to 3 as a seven-joint mechanism. The embodiment of the lever mechanism 20 is dependent on the flap movement to be achieved, of course, so that various flap movements can be achieved. Therefore, multi-arm or single-arm lever mechanisms can be used. A four-joint assembly, for example, is also possible as a multi-arm lever mechanism. The lever mechanism 20 can also comprise additional levers, which can be required, for example, in a so-called folding flap fitting to control the movement of the further flap screen.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 flap fitting
2 side wall
3 end face
4 opening
5 side surface
10 housing
11 side plate
12 frame
13 rivet
14 further rivet
20 lever mechanism
21 door bearing lever
211 joint section
212 bearing borehole
213 support section
214 receptacle for longitudinal adjustment eccentric
215 oblong hole for lateral adjustment
216 receptacle for inclination adjustment screw
217 access opening to the catch slide
218 borehole
219 bolt
22 transmission lever
221 control section
23 deflection lever
24 control lever
25 support arm
30 adjustment unit
31 installation plate
311 installation rail
312 installation borehole
313 guide profile
314 coupling borehole (for lateral adjustment)
315 rivet
316 intermediate layer
32 installation profile
321 longitudinal slot
322 catch lug
323 driver
324 recess
325 recess
33 lateral adjustment eccentric
34 adapter
341 oblong hole
342 oblong hole
343 driver section

344 coupling section (for vertical adjustment)
345 passage (for lateral adjustment eccentric)
346 coupling section (for lateral adjustment)
35 catch slide
351 bolt
352 spring
36 longitudinal adjustment eccentric
37 inclination adjustment screw
371 groove
372 external thread
373 threaded sleeve
40 spring unit
41 spring assembly
411 compression spring
42 spindle unit
43 intermediate lever
431 pressure roller
50 damping unit

The invention claimed is:

1. A side wall for a furniture body, the side wall comprising:

a front end face of the side wall, wherein an opening is formed in the front end face; and a flap fitting inserted or integrated in the side wall, wherein the flap fitting comprises a lever mechanism having a door bearing lever, an adjustment unit, and an installation plate, wherein a flap of the item of furniture is fastenable on the installation plate, wherein a lateral position and an inclination of the installation plate are settable by the adjustment unit in relation to the door bearing lever; and a housing having two parallel side plates arranged spaced apart from one another, wherein the lever mechanism with the door bearing lever and the adjustment unit is retracted between the two parallel side plates in a closed position of the flap fitting, wherein the lever mechanism of the flap fitting is extendible through the opening formed in the front end face, wherein the flap fitting is inserted into the sidewall through the opening into a receptacle formed behind the opening, the flap fitting, integrated into the side wall during manufacture of the side wall, or inserted laterally through a pocket that is introduced from a side surface of the side wall and the pocket has the opening formed in the front end face.

2. The side wall of claim 1, wherein the adjustment unit comprises a U-shaped outer profile, in which an adapter is mounted so that the adapter is longitudinally displaceable and pivotable.

3. The side wall of claim 2, wherein the U-shaped outer profile is integrally formed with the door bearing lever.

4. The side wall of claim 2, wherein the adapter has an oblong hole, through which a bolt leads, wherein the bolt is fastened in legs of the U-shaped outer profile.

5. The side wall of claim 4, wherein the adjustment unit comprises a U-shaped installation profile, which is mounted on the installation plate so that the adjustment unit is displaceable in a transverse direction.

6. The side wall of claim 5, wherein a base of the U-shaped installation profile rests on the installation plate, wherein the adapter is located at least partially between legs of the U-shaped installation profile.

7. The side wall of claim 6, wherein the legs of the U-shaped installation profile comprise recesses, wherein sections of the adapter are positioned in the recesses.

8. The side wall of claim 7, wherein the sections of the adapter positioned in the recesses are flush with an outer side of the legs of the U-shaped installation profile.

9. The side wall of claim 6, wherein a lateral adjustment eccentric for the lateral adjustment of the U-shaped installation profile in relation to the installation plate is arranged in the U-shaped installation profile.

10. The side wall of claim 9, wherein the lateral adjustment eccentric is arranged with a round head precisely between the legs of the U-shaped installation profile and engages with a driver pin positioned eccentrically on the round head in a coupling borehole of the installation plate.

11. The side wall of claim 5, wherein legs of the U-shaped installation profile comprise slots open toward one side, wherein the bolt engages in the slots.

12. The side wall of claim 11, wherein the adapter comprises a displaceable catch slide, which interacts with the U-shaped installation profile, on an end of the adapter that is opposite to the bolt.

13. The side wall of claim 12, wherein a catch lug, which engages behind the catch slide, is formed on the U-shaped installation profile.

14. The side wall of claim 2, further comprising:

a longitudinal adjustment eccentric, configured for the longitudinal displacement of the adapter in relation to the U-shaped outer profile, is arranged in the U-shaped outer profile.

15. The side wall of claim 14, wherein the longitudinal adjustment eccentric is rotatably mounted in the U-shaped outer profile and engages with a driver pin positioned eccentrically on a head in a transversely extending coupling slot of the adapter.

16. The side wall of claim 2, further comprising:

an inclination adjustment screw, configured for the inclination adjustment of the adapter in relation to the U-shaped outer profile, is arranged in the U-shaped outer profile.

17. The side wall of claim 16, wherein the inclination adjustment screw is screwed using an external thread into an internal thread of a receptacle on the U-shaped outer profile, wherein a groove is formed on a shaft of the inclination adjustment screw, wherein the groove engages in a receptacle of the adapter in such a way that the inclination adjustment screw is coupled to the adapter so the adapter is rotatable and longitudinally displaceable.

18. The side wall of claim 16, the inclination adjustment screw is rotatably mounted in the U-shaped outer profile and engages, using an external thread directly or via a threaded sleeve having a groove, in a receptacle of the adapter in such a way that the inclination adjustment screw is coupled to the adapter so that the adapter is longitudinally displaceable.

19. The side wall of claim 2, wherein the adjustment unit comprises operable adjustment means, which are operable from one side of the adjustment unit.

20. The side wall of claim 19, wherein the operable adjustment means are inoperable in the closed position of the flap fitting.

21. The side wall of claim 19, wherein the door bearing lever comprises a support section, at which the adjustment means are accessible, and the support section is concealed by the two parallel side plates in the closed position of the flap fitting.

22. The side wall of claim 1, wherein all joint axes of the lever mechanism mounted on the door bearing lever are concealed by the two parallel side plates in the closed position of the flap fitting.

23. The flap fitting side wall of claim 1, wherein the two parallel side plates have an internal spacing which is greater than a width of the adjustment unit and is less than 16 mm.

24. An item of furniture, comprising:

a furniture body comprising at least one side wall with a front end face, wherein an opening is formed in the front end face; and a guided flap, wherein the at least one side wall comprises a flap fitting inserted or integrated in the side wall, wherein the flap fitting comprises a lever mechanism having a door bearing lever, an adjustment unit, and an installation plate, wherein a flap of the item of furniture is fastenable on the installation plate, wherein a lateral position and an inclination of the installation plate are settable by the adjustment unit in relation to the door bearing lever; and a housing having two parallel side plates arranged spaced apart from one another, wherein the lever mechanism with the door bearing lever and the adjustment unit is retracted between the two parallel side plates in a closed position of the flap fitting, wherein the lever mechanism of the flap fitting is extendible through the opening formed in the front end face, wherein the flap fitting is inserted into the sidewall through the opening into a receptacle formed behind the opening, the flap fitting, integrated into the side wall during manufacture of the side wall, or inserted laterally through a pocket that is introduced from a side surface of the side wall and the pocket has the opening formed in the front end face.

* * * * *